US008171910B2

(12) United States Patent
Tachibana et al.

(10) Patent No.: US 8,171,910 B2
(45) Date of Patent: May 8, 2012

(54) CYLINDER LINER, CYLINDER BLOCK AND PROCESS FOR THE PREPARATION OF CYLINDER LINER

(75) Inventors: Yuki Tachibana, Tokyo (JP); Yoshiro Shina, Tokyo (JP); Makoto Miyasaka, Nagano (JP); Hiroki Shimizu, Nagano (JP); Daisuke Shinkai, Nagano (JP)

(73) Assignees: Fuji Jukogyo Kabushiki Kaisha, Tokyo (JP); Koyama Co., Ltd., Nagano (JP)

( * ) Notice: Subject to any disclaimer, the term of this patent is extended or adjusted under 35 U.S.C. 154(b) by 429 days.

(21) Appl. No.: 12/552,813

(22) Filed: Sep. 2, 2009

(65) Prior Publication Data

US 2010/0059012 A1 Mar. 11, 2010

(30) Foreign Application Priority Data

Sep. 5, 2008 (JP) ..... 2008-228329

(51) Int. Cl.
*F02F 1/00* (2006.01)

(52) U.S. Cl. ..... 123/193.2; 123/193.3; 123/668; 123/195 R

(58) Field of Classification Search ..... 123/193.2, 123/193.3, 668, 195 R
See application file for complete search history.

(56) References Cited

U.S. PATENT DOCUMENTS

| | | | | |
|---|---|---|---|---|
| 6,298,818 | B1 | 10/2001 | Koyama et al. | |
| 6,675,750 | B1 * | 1/2004 | Wagner | 123/41.84 |
| 7,000,584 | B1 * | 2/2006 | Wynveen et al. | 123/193.2 |
| 7,273,029 | B2 * | 9/2007 | Oda et al. | 123/193.2 |
| 2007/0012180 | A1 * | 1/2007 | Miyamoto et al. | 92/171.1 |
| 2007/0143996 | A1 * | 6/2007 | Michioka | 29/888.06 |

FOREIGN PATENT DOCUMENTS

| | | |
|---|---|---|
| JP | 7-139419 | 5/1995 |
| JP | 2001-227403 | 8/2001 |
| JP | 2001-334357 | 12/2001 |

* cited by examiner

*Primary Examiner* — Marguerite McMahon
*Assistant Examiner* — James Kim
(74) *Attorney, Agent, or Firm* — Smith, Gambrell & Russell, LLP

(57) ABSTRACT

The present invention a cylinder liner which controls gap formation at the interface between the cylinder liner and a cylinder block main body for accepting the cylinder liner therein, and serves to acquire closely contacting state and enhanced bonding strength between the cylinder liner and the cylinder block main body, and to provide a cylinder block, and further to provide a process for the preparation of the cylinder liner.

A plurality of circumferential grooves 15 extending in the circumferential direction is formed from a first circumferential groove 16 having a shape of "J" of the alphabet in sectional view and extending in a circumferential direction formed on an outer surface 12 of an cast iron cylinder liner 10, and a second circumferential groove 18 having a shape of "J" of the alphabet in sectional view and linking to the first circumferential groove 16. In enclosing the cylinder liner 10 in a cylinder block main body 30 by casting, the movement of a molten aluminum alloy is depressed by the circumferential grooves 15 and therefore a residual stress generated on the solidification and shrinkage is equally dispersed whereby cracking of the cylinder block body 3 can be prevented and close contact and bonding strength at interface between the cylinder liner 10 and the cylinder block main body 30 are ensured.

6 Claims, 25 Drawing Sheets

(a)

(b)

(a)

(b)

CYLINDER LINER, CYLINDER BLOCK AND PROCESS FOR THE PREPARATION OF CYLINDER LINER

CROSS REFERENCE TO RELATED APPLICATIONS AND INCORPORATION BY REFERENCE

This application based upon and claims the benefit of priority from the prior Japanese Patent Application No. 2008-228329, filed on Sep. 5, 2008; the entire content of which is incorporated herein by reference.

BACKGROUND

1. Field of the Invention

The present invention relates to a cylinder liner and a cylinder block enclosing-casting a cylinder liner therein to be used in an engine, and a process for the preparation of the cylinder liner.

2. Description of the Related Art

A cast iron cylinder block for an engine which has been put to practical use is prepared by enclosing a cast iron cylinder liner in a cylinder block main body by enclosing-casting method in order to reduce the weight and fuel consumption.

However, in the production by a conventional cylinder block having a cast iron cylinder liner, gaps or voids are occasionally formed at the interface between the cylinder block main body and the cylinder liner.

In case gaps are formed at the interface between the cylinder block main body and the cylinder liner, a thermal conductivity therebetween reduces to influence the cooling performance of the engine and to bring about variation of the thermal conductivity in the cylinder liner in the circumferential direction. The circumferential variation of the thermal conductivity of the cylinder liner causes the thermal conductivity of the cylinder liner to vary depending on the circumferential position. The variation of the thermal conductivity causes the cylinder liner not to expand with keeping a perfect circular shape, which results in that inner surface of the cylinder bore is deformed to have a distorted cylindrical shape. When a piston reciprocatingly moves in the deformed cylinder bore, the friction coefficient between the piston and the cylinder liner increases. Therefore, engine oil consumption and abrasion of the piston ring increase, which becomes factors for increased fuel consumption, reduced performance, and reduced durability of the engine.

Further, when water penetrates into the gap formed at the interface between the cylinder liner and the cylinder block main body, the cylinder liner suffers from rust development, which occasionally leads to deformation of the cylinder liner.

Furthermore, if there are gaps at the interface between the cylinder block main body and the cylinder liner enclosed therein by casting, when the inner surface of the cylinder bore is subjected to a machining process, elastic deformation, so-called spring-back of the cylinder liner occurs owing to load generated on processing of the cylinder liner to reduce processing accuracy of the cylinder liner. Moreover, the existence of the gaps at the interface repeatedly gives load to the cylinder liner, and therefore the cylinder liner is apt to be deformed with the passage of time. Similarly, when the thin portion of the cylinder block main body is processed by a machine, a load generated on the processing causes elastic deformation whereby the processed accuracy of the cylinder block is reduced.

An aluminum cylinder block is formed by casting a molten aluminum alloy around a cylinder liner. In the solidification and shrinkage of the molten aluminum alloy, the interface between the cylinder liner and the cylinder block main body receives large load generated by the residual stress mainly of the aluminum alloy and by the difference of thermal expansion ratio between the aluminum alloy and iron for the cylinder liner. In this case, when there are gaps formed at the interface between the cylinder liner and the cylinder block main body, the stress is concentrated in a portion around the gap, whereby the aluminum alloy cylinder block main body is damaged. Particularly, a thin portion of the cylinder block main body is apt to be damaged by concentration of the stress.

To solve the above-mentioned problem, known is a process for the preparation of cylinder block wherein a shot blasting is carried out with respect to the outer surface of the iron cylinder liner by using fine particles of steel, for activating the surface and for obtaining a rough surface. An aluminum cylinder block enclosing-casting the resultant cylinder block acquires excellent closely contact at the interface between the cylinder liner and the cylinder block main body.

As are disclosed in Japanese Kokai Publications No. 2001-227403, No. 2001-334357, and No. Hei-7(1995)-139419, known is a process for the preparation of cylinder block wherein a great number of grooves or protrusions is integrally formed on the surface of the cast iron cylinder liner, and the cylinder liner and the cast cylinder block main body are closely contacted with each other through their contact at interface therebetween.

Furthermore, in another known process for preparing a cylinder block, a Cu-based metal and Zn-based metal, which has good melting adhesiveness with the molten aluminum alloy, is applied to the cylinder block by plating, and a gas component such as hydrogen contained in the plated layer is removed by immersing the cylinder liner in a flux bath, and then the treated cylinder liner is enclosed in the cylinder block main body by enclosing-casting method. Thus, the cylinder liner and the cast cylinder block main body are closely contacted with each other through their contact at interface therebetween.

SUMMARY OF THE INVENTION

The above-mentioned process using the shot blasting to render the outer surface of the cylinder liner rough can be carried out in relatively small cost, and the flowability of the aluminum alloy is increased. Further, the close contact (adhesion) at the interface between the cylinder block main body and the cylinder liner is increased. In contrast, the bond strength between the cylinder block main body and the cylinder liner is reduced, and therefore the cylinder liner is apt to suffer from stress such as residual stress or shrinkage generated on the solidification of the molten aluminum alloy used for enclosing-casting, whereby it is difficult to acquire an interface free from gaps between the cylinder block main body and the cylinder liner.

According to the process disclosed in the above-mentioned publications, wherein a great number of grooves or protrusions is integrally formed on the outer surface of the cylinder liner and the resultant cylinder liner is enclosed-casted in the aluminum alloy, though the bonding strength is increased to some extent by a mechanical factor, the grooves or the protrusions hinder the flow of the melt of the aluminum alloy and hence the interface between the cylinder liner and the cylinder block main body is apt to have a nonuniform contacting state. Further, there are various limitations for forming a great number of protrusions on the outer surface of the cylinder liner by the machining process, and hence the manufacturing cost may be increased.

According to the above-mentioned process wherein a metal such as Cu-based or Zn-based metal is plated on the outer surface of the cylinder liner and the treated cylinder liner is enclosed in the cylinder block main body by enclosing-casting method, the thickness of the plating layer of Cu-based material or Zn-based material is easily varied and therefore the contacting state between the cylinder liner and the plated layer may become nonuniform. Such variation and nonuniformity largely affect the surface structure of the cylinder liner. If the thickness of the plating layer, or contacting state between the plating layer and the cylinder liner varies when the molten aluminum alloy is introduced, a metal compound formed by the reaction between the plating layer and the aluminum alloy varies in thickness, and consequently, nonuniform interfaces are formed, and the interface may suffer from occurrence of gaps and instability of bonding strength.

An object of the present invention is to provide a cylinder liner which controls gap formation at the interface between the cylinder liner and a cylinder block main body for accepting the cylinder liner therein, and which serves to acquire closely contacting state and enhanced bonding strength between the cylinder liner and the cylinder block main body, and to provide a cylinder block, and further to provide a process for the preparation of the cylinder liner.

The present first invention to attain the object is provided by a cast iron cylinder liner having a shape of cylinder hollow to be enclosed in a cylinder block main body made of aluminum alloy by enclosing-casting method, which comprises a plurality of strip-shaped plane surfaces circularly extending in a circumferential direction of the cylinder liner, the circular strip-shaped plane surfaces being formed on an outer circumferential surface of the cylinder liner at intervals in the axis direction, and a plurality of circumferential grooves extending in the circumferential direction, the circumferential grooves being formed between the adjacent strip-shaped plane surfaces, each of the circumferential grooves of the cylinder liner in an axial sectional view comprising:

a first circumferential groove comprising, a first slant surface whose diameter is gradually reduced with moving from an outer circumferential edge of a strip-shaped plane surface existing in one end side in an axial direction of the cylinder liner to the one end side in the axial direction of the cylinder liner to undercut a support portion of the strip-shaped plane surface, a first curved surface whose diameter is gradually reduced with moving from an inner circumferential end of the first slant surface, and a second slant surface whose diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and a second circumferential groove comprising, a third slant surface which continuously links to an outer circumferential end of the second slant surface and whose diameter is gradually reduced with moving to the other end side in the axial direction of the cylinder liner, a second curved surface whose diameter is gradually increased with moving from an inner circumferential end of the third slant surface, and a fourth slant surface whose diameter is increased with moving from an outer circumferential end of the second curved surface to the one end side in the axial direction of the cylinder liner, which faces the third slant surface and whose outer circumference end links to an outer circumferential end of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

According to the above invention, a plurality of circumferential grooves extending in a circumferential direction of the cylinder liner are provided on an outer circumferential surface of the cylinder liner, and each of the circumferential grooves is structured by a first circumferential groove formed at the edge of a strip-shaped plane surface existing in one end side in an axial direction of the cylinder liner so as to undercut a support portion of the strip-shaped plane surface in a shape of "J" and a second circumferential groove continuously linked to the first circumferential groove and formed at the edge of an adjacent strip-shaped plane surface existing in an end side in an axial direction of the cylinder liner so as to undercut a support portion of the adjacent strip-shaped plane surface in a shape of "J". Therefore when the molten aluminum alloy used for enclosing-casting the cylinder liner is solidified and shrunk, the movement of the molten aluminum alloy is restricted in the axial direction, and hence stress in the axial direction generated in the solidification and shrinkage of the molten aluminum alloy is equally dispersed whereby residual stress generated in the shrunk aluminum alloy is reduced and equally dispersed to prevent the cylinder block main body from breaking.

Further, various stresses such as peeling stress, processing stress on machining process and residual stress, which are generated in the cylinder block main body enclosing the cylinder liner, are received by the circumferential groove formed from the first and second circumferential grooves in a shape of "J" to prevent occurrence of gaps at an interface between the cylinder liner and cylinder block main body. Therefore, close contact between the cylinder liner made of cast iron and cylinder block main body made of aluminum alloy is stably maintained and hence good bonding strength therebetween can be ensured.

The present second invention to attain the object is provided by a cast iron cylinder liner having a shape of cylinder hollow to be enclosed in a cylinder block main body made of aluminum alloy by enclosing-casting method, which comprises a strip-shaped plane surface spirally extending in a circumferential direction of the cylinder liner, the spiral strip-shaped plane surface being formed on an outer circumferential surface of the cylinder liner at intervals in the axis direction, and a circumferential groove spirally and continuously formed between the spiral strip-shaped plane surface, the circumferential groove of the cylinder liner in an axial sectional view comprising:

a first circumferential groove comprising, a first slant surface whose diameter is gradually reduced with moving from an outer circumferential edge of a strip-shaped plane surface existing in one end side in an axial direction of the cylinder liner to the one end side in the axial direction of the cylinder liner to undercut a support portion of the strip-shaped plane surface, a first curved surface whose diameter is gradually reduced with moving from an inner circumferential end of the first slant surface, and a second slant surface whose diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in section view;

and a second circumferential groove comprising, a third slant surface which continuously links to an outer circumferential end of the second slant surface and whose diameter is gradually reduced with moving to the other end side in the axial direction of the cylinder liner, a second curved surface whose diameter is gradually increased with moving from an inner circumferential end of the third slant surface, and a fourth slant surface whose diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in section view.

According to the above invention, a spiral circumferential groove extending from one end side to the other end side in an axial direction of the cylinder liner is provided on an outer circumferential surface of the cylinder liner, and the circumferential groove is structured by a first circumferential groove formed at the edge of a strip-shaped plane surface existing in one end side in an axial direction of the cylinder liner so as to undercut a support portion of the strip-shaped plane surface in a shape of "J" and a second circumferential groove continuously linked to the first circumferential groove and formed at the edge of an adjacent strip-shaped plane surface existing in an end side in an axial direction of the cylinder liner so as to undercut a support portion of the adjacent strip-shaped plane surface in a shape of "J". Therefore when the molten aluminum alloy used for enclosing-casting the cylinder liner is solidified and shrunk, the movement of the molten aluminum alloy is restricted in the axial direction, and therefore stress in the axial direction generated in the solidification and shrinkage of the molten aluminum alloy is equally dispersed whereby residual stress generated in the shrunk aluminum alloy is reduced and equally dispersed to prevent the cylinder block main body from breaking.

Further, various stresses such as peeling stress, processing stress on machining process and residual stress, which are generated in the cylinder block main body enclosing the cylinder liner, are received by the spiral-shaped circumferential groove formed from the first and second circumferential grooves in a shape of "J" to prevent occurrence of gaps at an interface between the cylinder liner and cylinder block main body. Therefore, close contact between the cylinder liner made of cast iron and cylinder block main body made of aluminum alloy is stably maintained and hence good bonding strength therebetween can be ensured.

In the above-mentioned inventions, the cylinder block preferably comprises the cylinder block main body made of aluminum alloy and the cast iron cylinder liner enclosed therein, which is obtained by enclosing the cast iron cylinder liner in the aluminum alloy cylinder block by enclosing-casting method. Thereby, close contact between the cylinder liner made of cast iron and cylinder block main body made of aluminum alloy is stably maintained and hence good bonding strength therebetween is highly ensured, whereby a high quality cylinder block can be obtained.

The present third invention to attain the object is provided by a process for the preparation of a cast iron cylinder liner having a shape of cylinder hollow to be enclosed in a cylinder block main body made of aluminum alloy by enclosing-casting method, which comprises a plurality of strip-shaped plane surfaces circularly extending in a circumferential direction of the cylinder liner, the circular strip-shaped plane surfaces being formed on an outer circumferential surface of the cylinder liner at intervals in the axis direction, and a plurality of circumferential grooves extending in the circumferential direction, the circumferential grooves being formed between the adjacent strip-shaped plane surfaces, comprising the following steps:

rotating a cylinder liner material casted in the form of circular cylinder around its central axis, and applying a working tool onto an outer circumferential surface of the material to cut a plurality of first circumferential grooves in the axial direction at intervals, each of the first circumferential grooves comprising, a first slant surface which, in its axial sectional view, has circular shape and whose diameter is gradually reduced with moving from an outer circumferential edge of a strip-shaped plane surface existing in one end side in an axial direction of the cylinder liner to the one end side in the axial direction of the cylinder liner to undercut a support portion of the strip-shaped plane surface, a first curved surface whose, in its axial sectional view, diameter is gradually reduced with moving from an inner circumferential end of the first slant surface, and a second slant surface whose, in its axial sectional view, diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and rotating the cylinder liner material, on which the plurality of first circumferential grooves have been provided by the cutting, around its central axis, and applying a working tool onto the material to cut a plurality of second circumferential grooves in the axis direction at intervals, each of the second circumferential grooves comprising, a third slant surface which, in its axial sectional view, continuously links to an outer circumferential end of the second slant surface and whose diameter is gradually reduced with moving to the other end side in the axial direction of the cylinder liner, a second curved surface whose, in its axial sectional view, diameter is gradually increased with moving from an inner circumferential end of the third slant surface, and a fourth slant surface whose, in its axial sectional view, diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

According to the above invention, the cylinder liner can be efficiently prepared by rotating a cylinder liner material casted in the form of circular cylinder around its central axis and applying a working tool onto the outer circumferential surface to cut a plurality of first circumferential grooves having a shape of "J" of the alphabet in sectional view at intervals, and then rotating the cylinder liner material having the plurality of first circumferential grooves thereon around its central axis and applying a working tool onto the material to cut a plurality of second circumferential grooves having a shape of "J" of the alphabet in sectional view at intervals. That is, the cylinder liner can be easily prepared, for example, by using a lathe as the working tool.

The present forth invention to attain the object is provided by a process for the preparation of a cast iron cylinder liner having a shape of cylinder hollow to be enclosed in a cylinder block main body made of aluminum alloy by enclosing-casting method, which comprises a strip-shaped plane surface spirally extending in a circumferential direction of the cylinder liner, the spiral strip-shaped plane surface being formed on an outer circumferential surface of the cylinder liner at intervals in the axis direction, and a circumferential groove spirally and continuously formed between the spiral strip-shaped plane surface, comprising the following steps:

rotating a cylinder liner material casted in the form of circular cylinder around its central axis, and applying a working tool onto an outer circumferential surface of the material with moving the tool from one end side in an axis direction of the cylinder liner to the other side end in parallel to the central axis, to cut a first circumferential groove, the first circumferential groove comprising, a spiral first slant surface whose, in its axial sectional view, diameter is gradually reduced with moving from an outer circumferential edge of a strip-shaped plane surface existing in the one end side in an axial direction of the cylinder liner to the one end side in the axial direction of the cylinder liner to undercut a support portion of the strip-shaped plane surface, a first curved surface whose, in its axial sectional view, diameter is gradually reduced with moving from an inner circumferential end of the first slant surface, and a second slant surface whose, in its axial sectional view, diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and rotating the cylinder liner material, on which the spiral first circumferential groove has been provided by the cutting, around its central axis in a direction opposite to the above-mentioned rotating direction, and applying a working tool onto an outer circumferential surface of the material with moving the tool from the other end side in an axis direction of the cylinder liner to the one side end and in parallel to the central axis, to cut a second circumferential groove, the second circumferential groove comprising, a spiral third slant surface which, in its axial sectional view, continuously links to an outer circumferential end of the second slant surface and whose diameter is gradually reduced with moving to the other end side in the axial direction of the cylinder liner, a second curved surface, in its axial sectional view, whose diameter is gradually increased with moving from an inner circumferential end of the third slant surface, and a fourth slant surface, in its axial sectional view, whose diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

According to the above invention, the cylinder liner can be efficiently prepared by rotating a cylinder liner material casted in the form of circular cylinder around its central axis and applying a working tool onto the outer circumferential surface with moving the tool from the one end side in an axis direction of the cylinder liner to the other side end in parallel to the central axis to cut a first spiral circumferential groove having a shape of "J" of the alphabet in sectional view at intervals, and rotating the cylinder liner material having the first circumferential grooves thereon around its central axis in a direction opposite to the above-mentioned rotating direction, and applying a working tool onto the outer circumferential surface of the material with moving the tool from the other end side in an axis direction of the cylinder liner to the one side end in parallel to the central axis to cut a second spiral circumferential groove having a shape of "J" of the alphabet in sectional view at intervals. That is, the cylinder liner can be easily prepared, for example, by using a lathe as the working tool.

EFFECT OF THE INVENTION

According to the present invention, when the molten aluminum alloy used for enclosing the cylinder liner by enclosing-casting method is solidified and shrunk, the movement of the molten aluminum alloy is restricted in the axial direction, and therefore residual stress in the axial direction generated in the solidification and shrinkage of the molten aluminum alloy is equally dispersed and reduced, whereby the cylinder block main body is prevented from breaking. Simultaneously, various stresses such as peeling stress, processing stress on machining process and residual stress, which are generated in the cylinder block enclosing the cylinder liner, are received by the circumferential groove(s) of the cylinder liner to prevent occurrence of gaps at an interface between the cylinder liner and cylinder block main body. Therefore, close contact between the cylinder liner made of cast iron and cylinder block main body made of aluminum alloy is stably maintained and hence good bonding strength therebetween can be ensured.

DETAILED DESCRIPTION OF THE INVENTION

Embodiments of a cylinder liner, a cylinder block and a process for the preparation of cylinder liner according to the invention are explained by reference of drawings.

(First Embodiment)

Figure 1:
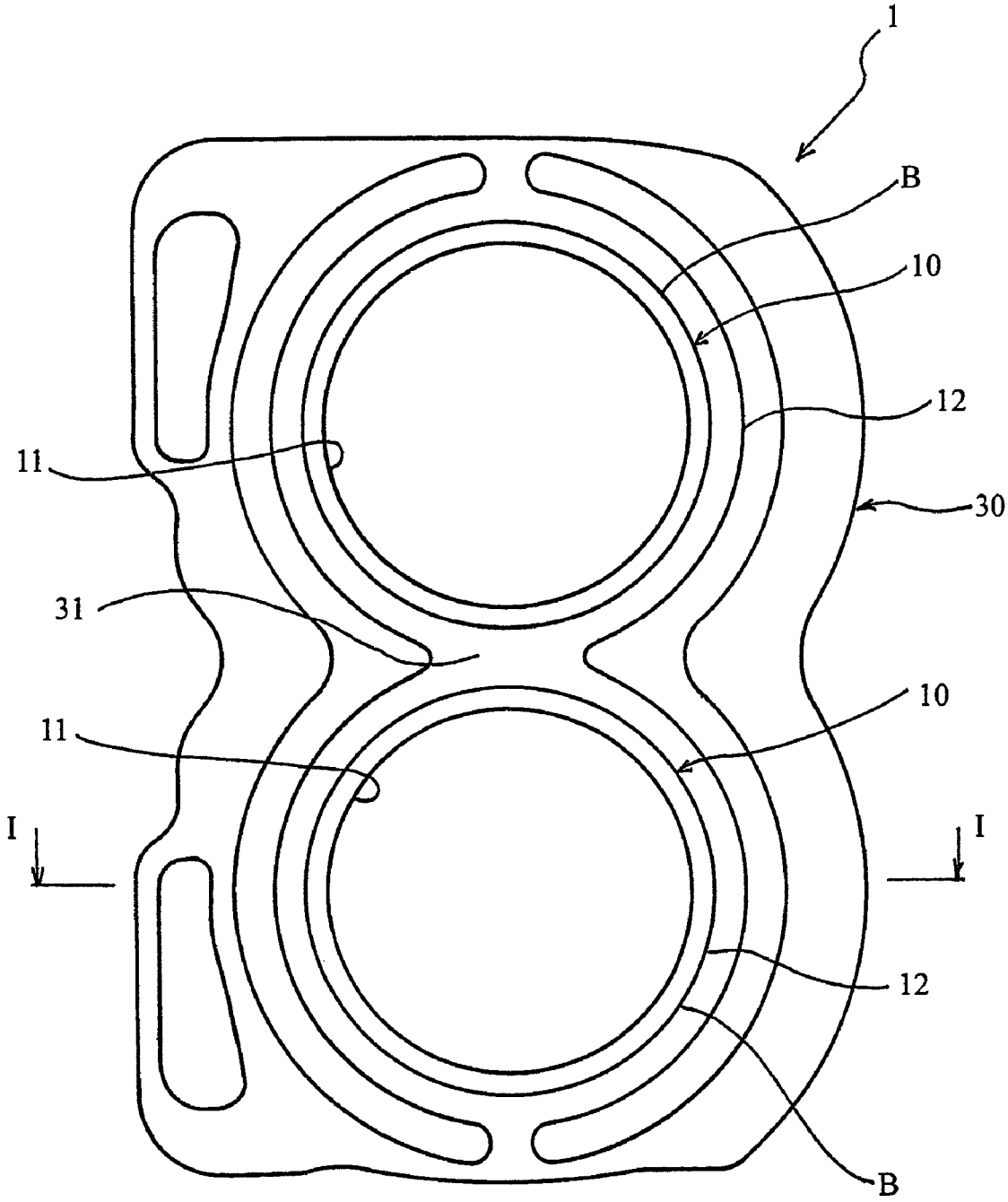
FIG. 1 is a plan view of a cylinder block according to a first embodiment of the invention.
Figure 2:
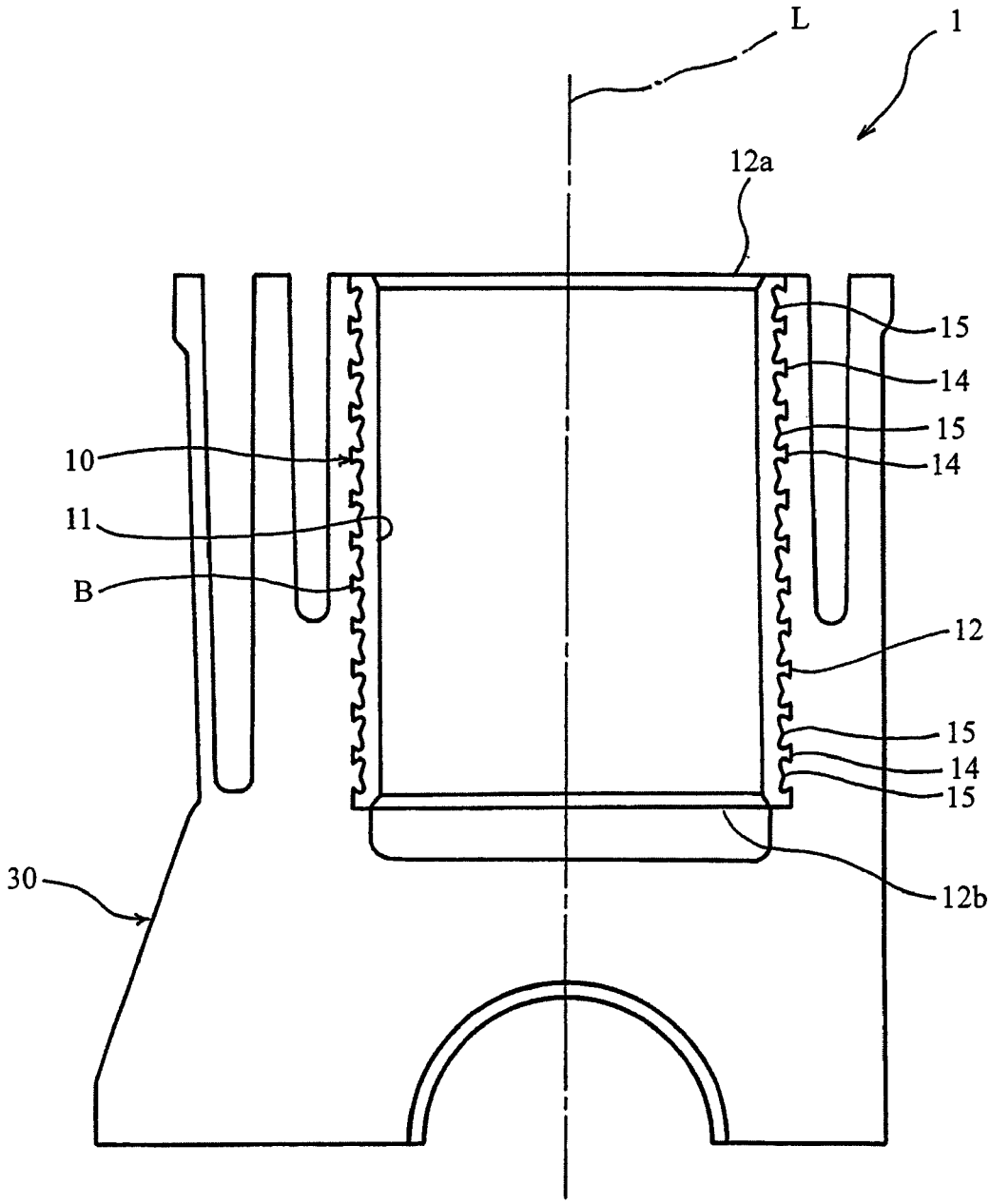
FIG. 2 is a section view of the cylinder block of FIG.1 by a line I-I.

The first embodiment of the present invention is explained by reference of FIGS. 1 to 13. FIG. 1 is a plan view of a cylinder block 1 obtained by enclosing-casting a cylinder liner 10 in a cylinder block main body 30 made of aluminum alloy which will become molten metal, FIG. 2 is a section view of FIG. 1 by a line I-I, FIG. 3 is a perspective view of the cylinder liner 10, and FIG. 5 is a section view of FIG. 3 by a line II-II.

Figure 3:
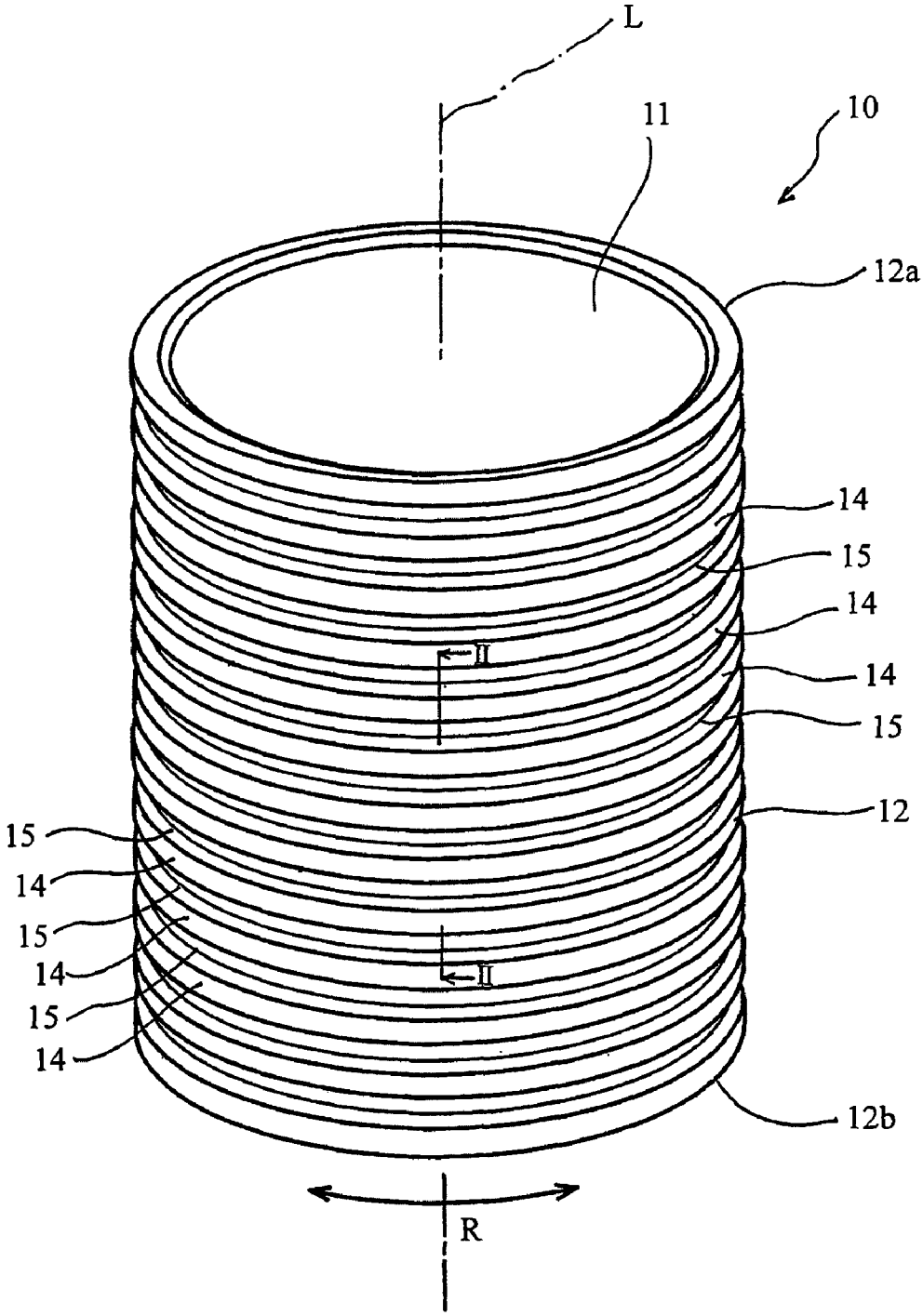
FIG. 3 is a perspective view of the cylinder liner according to a first embodiment of the invention.
Figure 4:
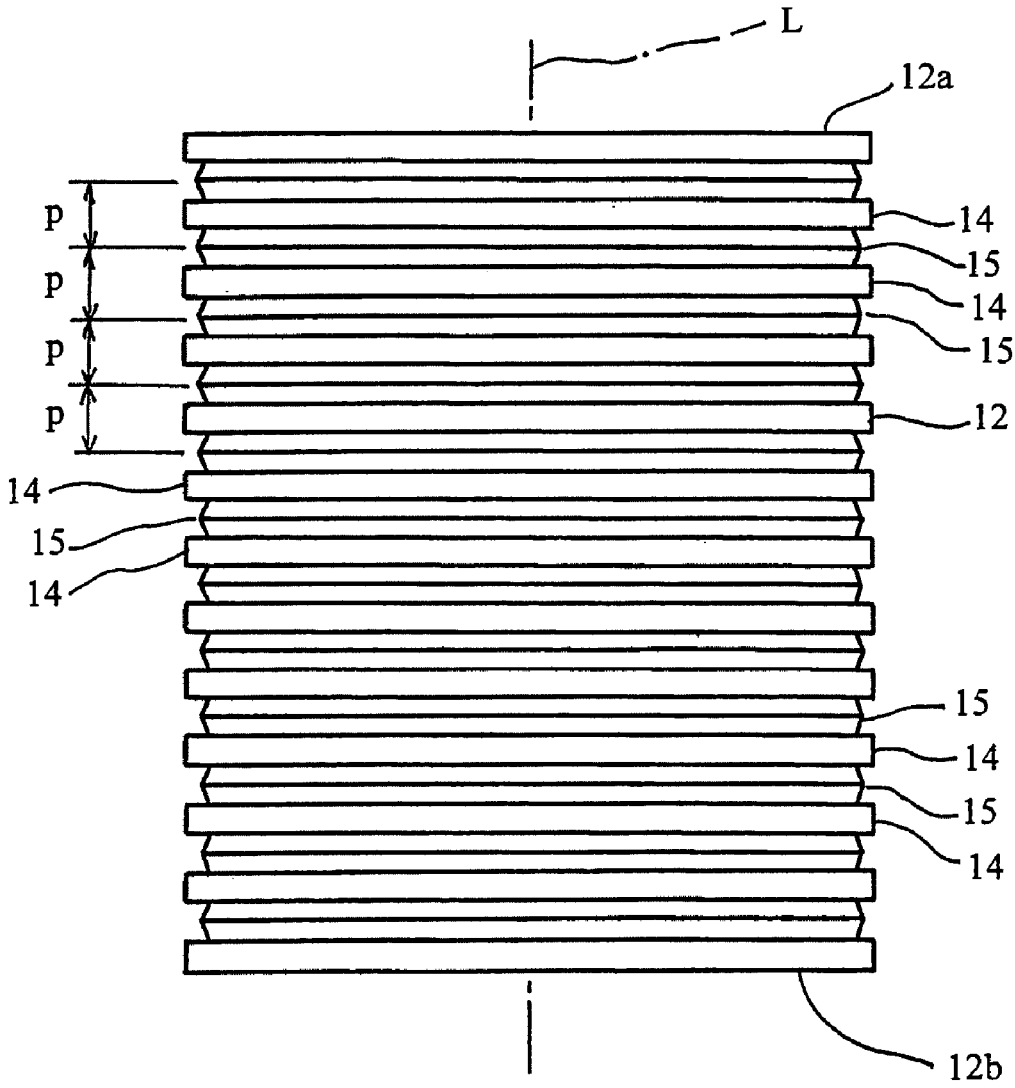
FIG. 4 is a side elevation of the cylinder liner according to a first embodiment of the invention.
Figure 5:
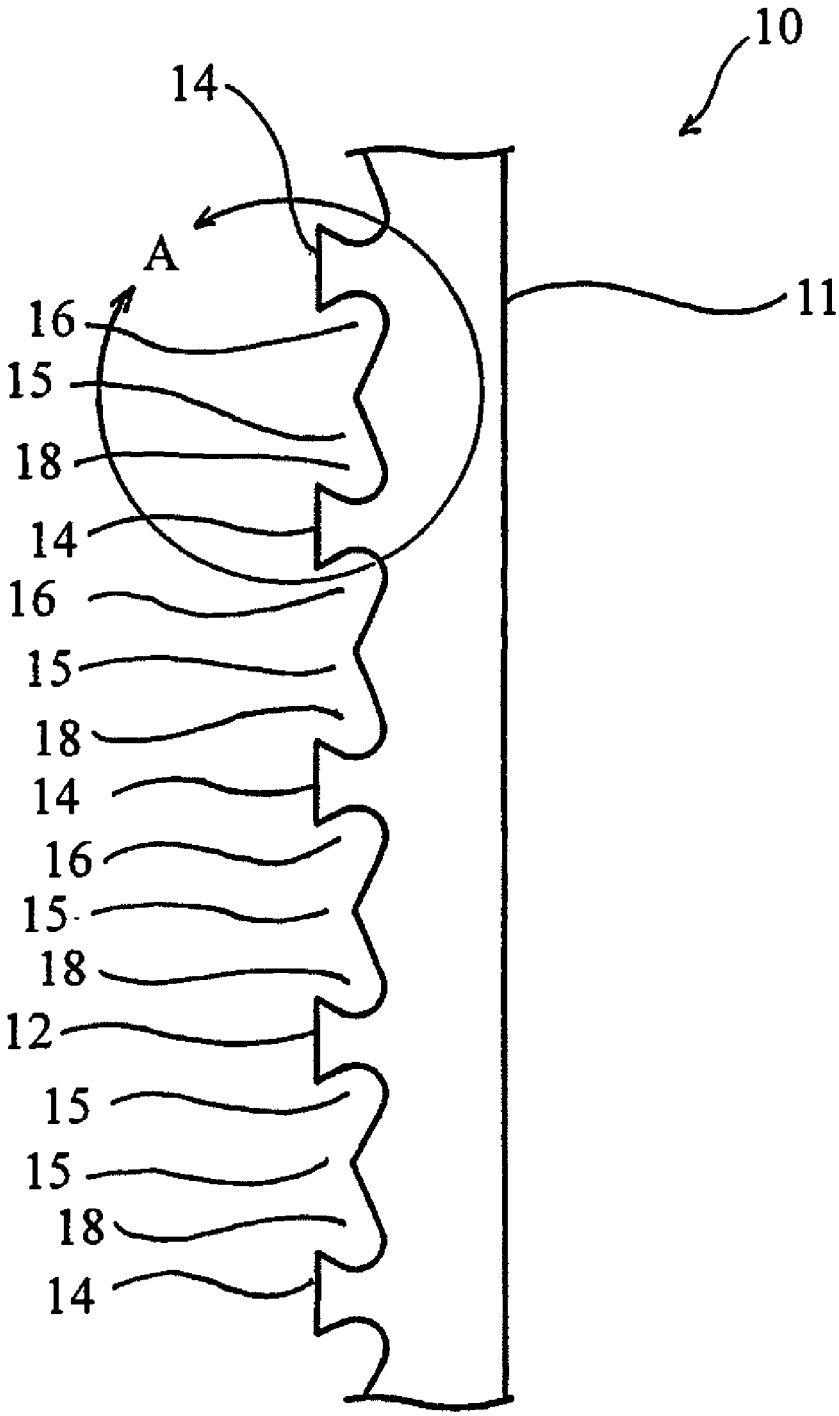
FIG. 5 is an expanded main view of a section view of FIG. 3 by a line II-II.

The cylinder liner 10 is cylindrically formed so as to have an inner surface 11 and an outer circumferential surface 12 of a cylinder bore having circular form in cross-section, which extends in the axial direction centered in a central axis L, as shown in FIGS. 3 to 5. A plurality of circular strip-shaped plane surfaces 14 are formed axially at intervals p on the outer circumferential surface 12 of the cylinder liner, the strip-shaped plane surfaces 14 extending in the circumferential direction R in parallel to the central axis L throughout the range from the one end 12*a* in an axial direction of the cylinder liner to the other end 12*b*, and a plurality of circumferential grooves 15 extending in the circumferential direction R between the adjacent circular strip-shaped plane surfaces (ring-shaped plane surfaces) 14 are formed.

Figure 6:
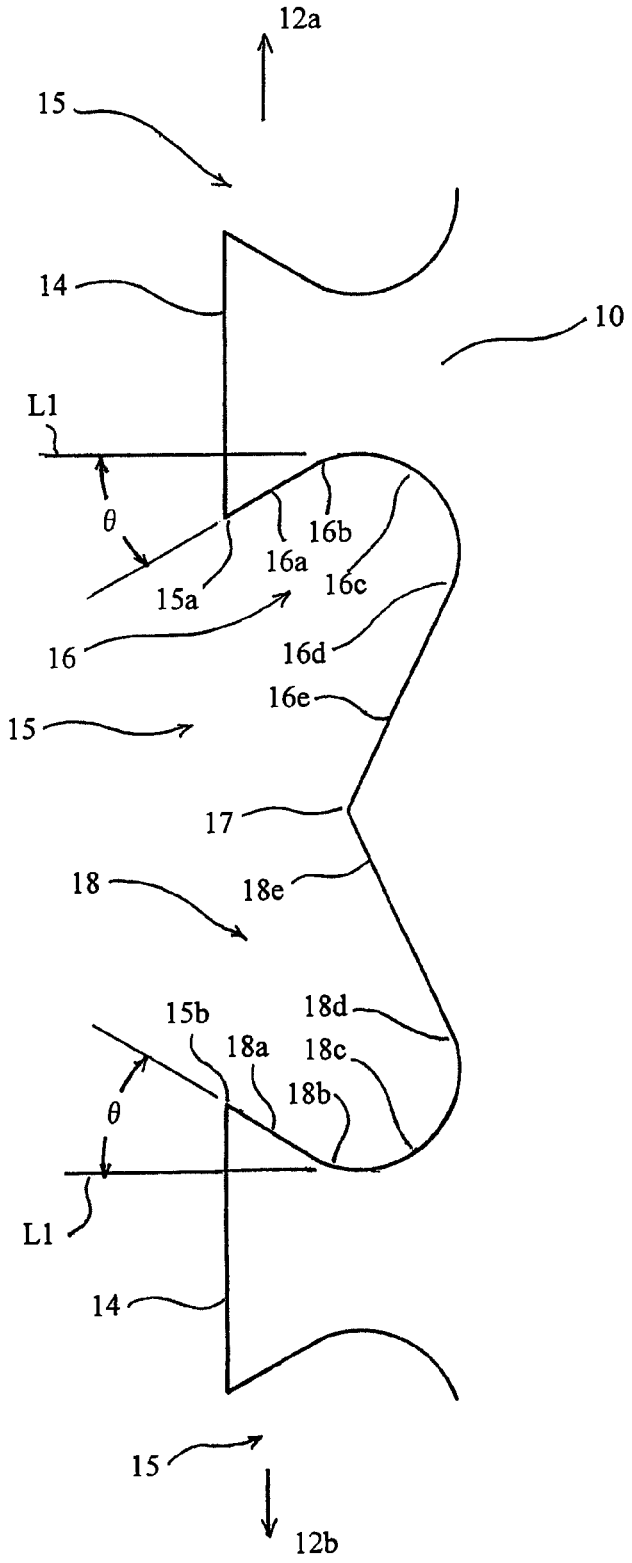
FIG. 6 is an expanded main view of "A" part of FIG. 5.

As shown in FIG. 6 illustrating an expanded main view of "A" part of FIG. 5, the circumferential groove 15 seen in an axial sectional view is formed from a first circumferential groove 16 and a second circumferential groove 18; and the first circumferential groove 16 is composed of a first slant surface 16*a* whose diameter is gradually reduced with moving from an outer circumferential end 15*a* corresponding to an edge of a strip-shaped plane surface 14 existing in one end 12*a* side in an axial direction of the cylinder liner to the one end 12*a* side in the axial direction to form a taper shape, a first curved surface 16*c* whose diameter is gradually reduced in the form of arc with moving from an inner circumference end 16*b* of the first slant surface 16*a* and which corresponds to a first groove bottom, and a second slant surface 16*e* whose diameter is gradually increased with moving from an inner circumferential end 16*d* of the first curved surface 16*c* to the other end 12*b* side in the axial direction of the cylinder liner to form a taper shape and to face the first curved surface 16*c*, and these first slant surface 16*a*, first curved surface 16*c*, and second slant surface 16*e* being continuously linked to each other in this order to form a shape of "J" of the alphabet in sectional view; and the second circumferential groove 18 is composed of a third slant surface 18*e* which continuously links to a ridge line 17 corresponding to an outer circumference end of the second slant surface 16*e* and whose diameter is gradually reduced with moving to the other end 12*b* side in the axial direction of the cylinder liner to form a taper shape, a second curved surface 18*c* whose diameter is gradually increased in the form of arc with moving from an inner circumference end 18*d* of the third slant surface 18*e* to form a second groove bottom, and a fourth slant surface 18*a* whose diameter is gradually increased with moving from an outer circumference end 18*b* of the second curved surface 18*c* to the one end 12*a* side in the axial direction of the cylinder liner to form a taper shape and to face the third curved surface 18*e* and whose outer circumference end links to a second outer circumferential end 15*b* corresponding to an edge of a strip-shaped plane surface 14 existing in an end 12*b* side in an axial direction of the cylinder liner, these third slant surface 18*e*, second curved surface 18*c* and fourth slant surface 18*a* being continuously linked to each other in this order to form a shape of "J" of the alphabet in sectional view; the first circumferential groove 16 and the second circumferential groove 18 being symmetrically placed with respect to the ridge line 17.

The first slant surface 16*a* and the fourth slant surface 18*a* have a slant angle θ of 3° to 35° (degree) with respect to a radial reference line L1 perpendicular to a central axis L, and the areas of the first slant surface 16*a* and the fourth slant surface 18*a* form an undercut (portion undercutting a support portion of a strip-shaped plane surface). In more detail, a first circumferential groove 16 slanting from a groove bottom in one end 12*a* side in an axial direction of the cylinder liner to an other end 12*b* side in an axial direction and a second circumferential groove 18 slanting from a groove bottom in the other end 12*b* side in an axial direction to the one end 12*a* side in an axial direction symmetrically link to each other with respect to a ridge line 17 to form a circumferential groove 15, which opens between adjacent strip-shaped plane surfaces 14.

A resultant cylinder liner 10 is subjected to an enclosing-casting process. A plurality of cylinder liners 10 (two cylinder liners in this embodiment) are placed in parallel in a mold, and enclosed by casting a molten aluminum alloy, whereby a cylinder block 1 can be obtained, wherein cylinder liners 10 enclosed in a cylinder block main body 30 of an aluminum alloy and the cylinder block main body 30 are integrated, as shown in FIGS. 1 and 2.

Figure 7:
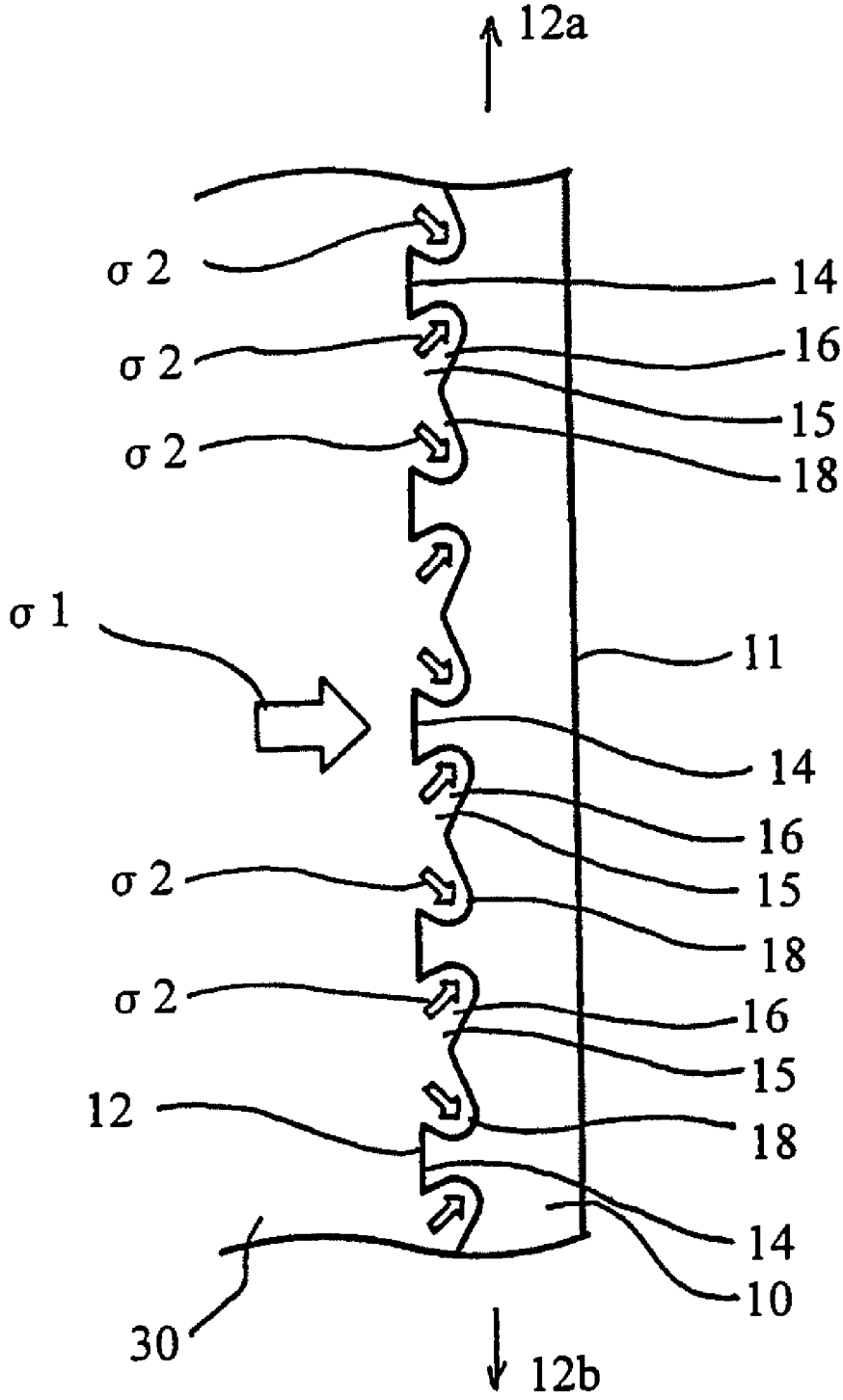
FIG. 7 is a view for explaining action of shrinkage stress generated by the solidification and shrinkage of the molten aluminum alloy according to a first embodiment of the invention.

In the enclosing-casting process, the molten aluminum alloy is flowed in a circumferential groove 15, and on the solidification and shrinkage of the molten aluminum alloy, a shrinkage stress σ1 acts in the direction perpendicular to a strip-shaped plane surface 14 and simultaneously an axial shrinkage generated on the solidification is equally received by first circumferential grooves 16 and second circumferential grooves 18 of a number of circumferential grooves 15 formed on the circumferential surfaces 12 of the cylinder liner 10 to prevent the molten aluminum alloy from moving in an axial direction, as shown in FIG. 7. Thereby, an axial shrinkage stress σ2 generated on the solidification and shrinkage of the molten aluminum alloy is equally dispersed along the circumferential surfaces 12 of the cylinder liner 10, and therefore a residual stress generated in the aluminum alloy after shrinkage can be reduced and equally dispersed. The reduction and equalization relax a residual stress of the cylinder block main body 30. In more detail, the residual stress of the cylinder block main body 30, particularly a thin-walled portion 31 thereof formed between adjacent cylinder liners 10, is relaxed whereby the cylinder block main body 30 can be prevented from breaking (cracking).

Figure 8:
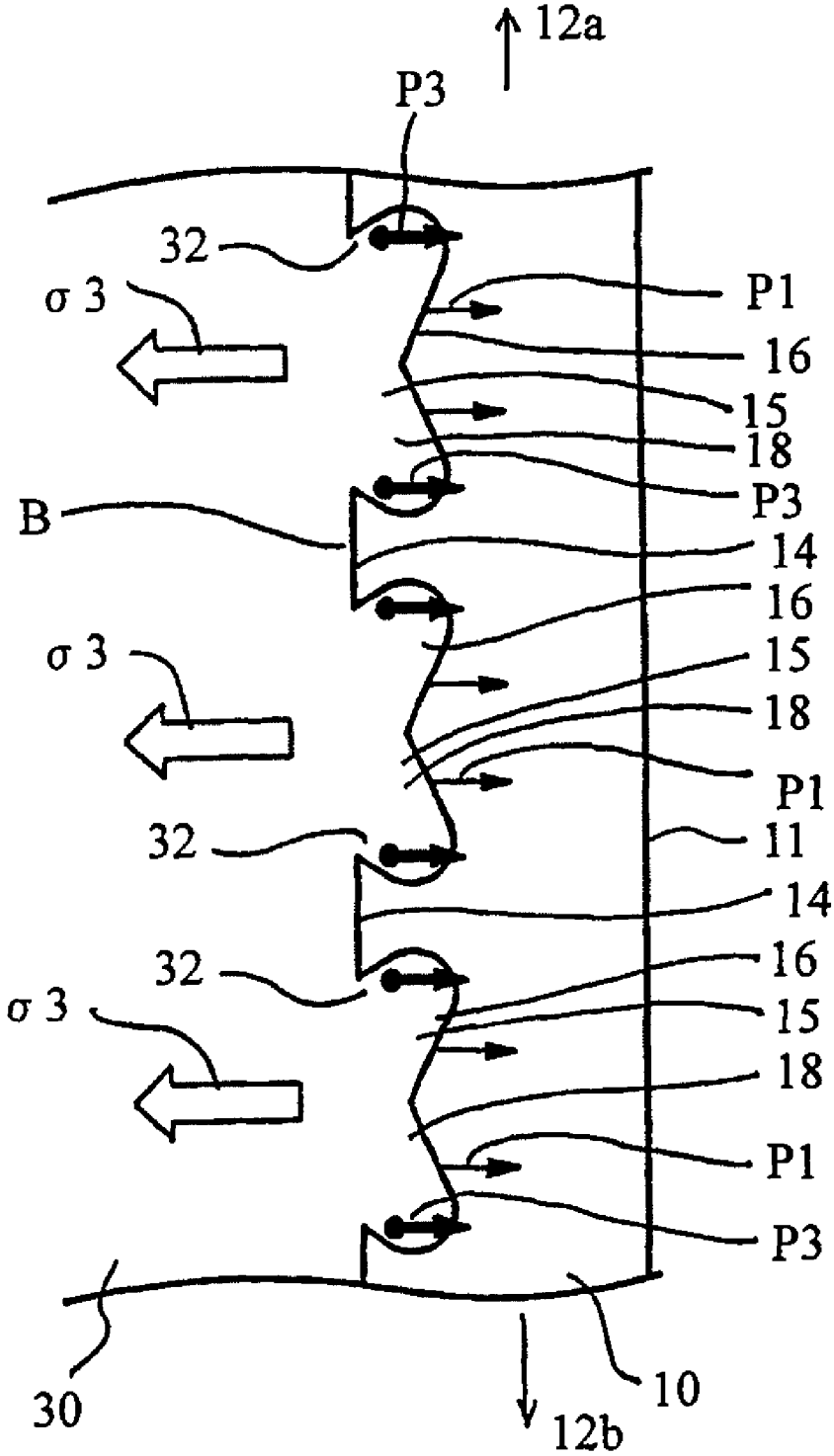
FIG. 8 is a view for explaining peeling stress acting on the cylinder block according to a first embodiment of the invention.

A residual stress and a thermal expansion difference generated on the solidification and shrinkage of the molten aluminum alloy enclosing a cast iron cylinder liner 10 give a high stress to the cylinder main body 30 made of the molten aluminum alloy enclosing the cast iron cylinder liner 10, and hence a peeling stress σ3 is occasionally generated in the direction peeling the cylinder block main body 30 from the circumferential surface 12 of the cylinder liner 10, as shown in FIG. 8.

A portion 32 of the cylinder block main body 30 flowed into the circumferential groove 15 of the cylinder liner 10 is received by the first circumferential groove 16 and second circumferential grooves 18 of the circumferential groove 15 of the cylinder liner 10, particularly the ranges of from an approximate outer circumferential end of the undercut first curved surface 16*c* to the first slant surface 16*a* and from an approximate outer circumferential end of the second curved surface 18*c* to the fourth slant surface 18*a*, whereby a drag P3 acts against the peeling stress σ3. Hence, a close contact force P1 between the cylinder liner 10 and the cylinder block main body 30 is ensured, and therefore occurrence of gaps can be prevented at interface B between the cylinder liner 10 and the cylinder block main body 30.

Figure 9:
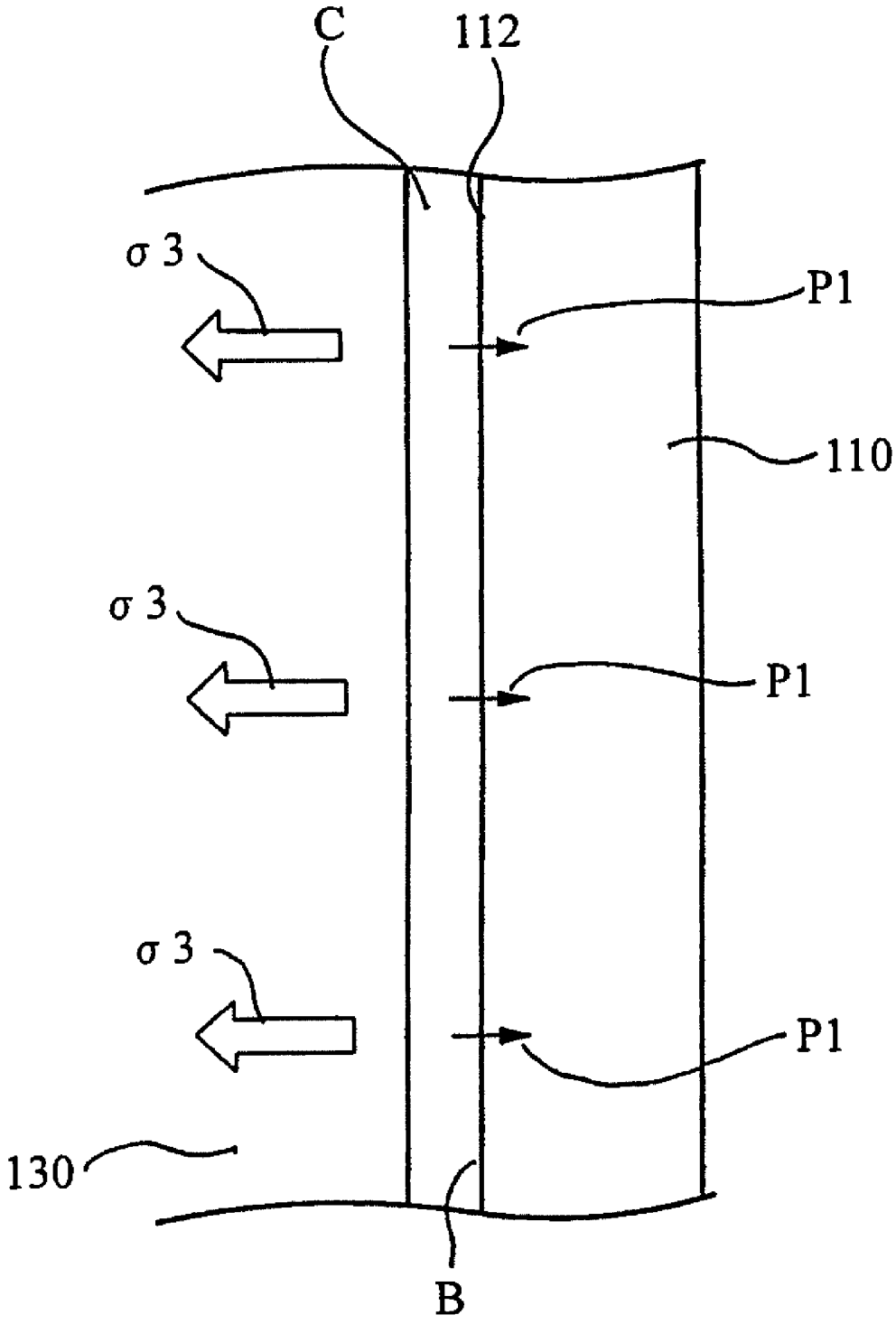
FIG. 9 is a view for explaining an embodiment compared with the embodiment of the invention illustrated in FIG. 8.

In contrast, in a comparative explanation view of FIG. 9 corresponding to FIG. 8, a cylinder block main body 130 enclosing in aluminum alloy a cylinder liner 110 provided with an outer circumferential plain surface 112 having no circumferential groove is shown. In case a peeling stress σ3 in the direction peeling the cylinder block main body 130 from the cylinder liner 110 is generated by residual stress and thermal expansion difference generated on the solidification and shrinkage the molten aluminum alloy, the cylinder block main body 130 is peeled form the cylinder liner 110 against the close contact force P1 between the cylinder liner 110 and the cylinder block main body 130 whereby gaps C occasionally occur at interface B between the cylinder liner 110 and the cylinder block main body 130.

Figure 10:
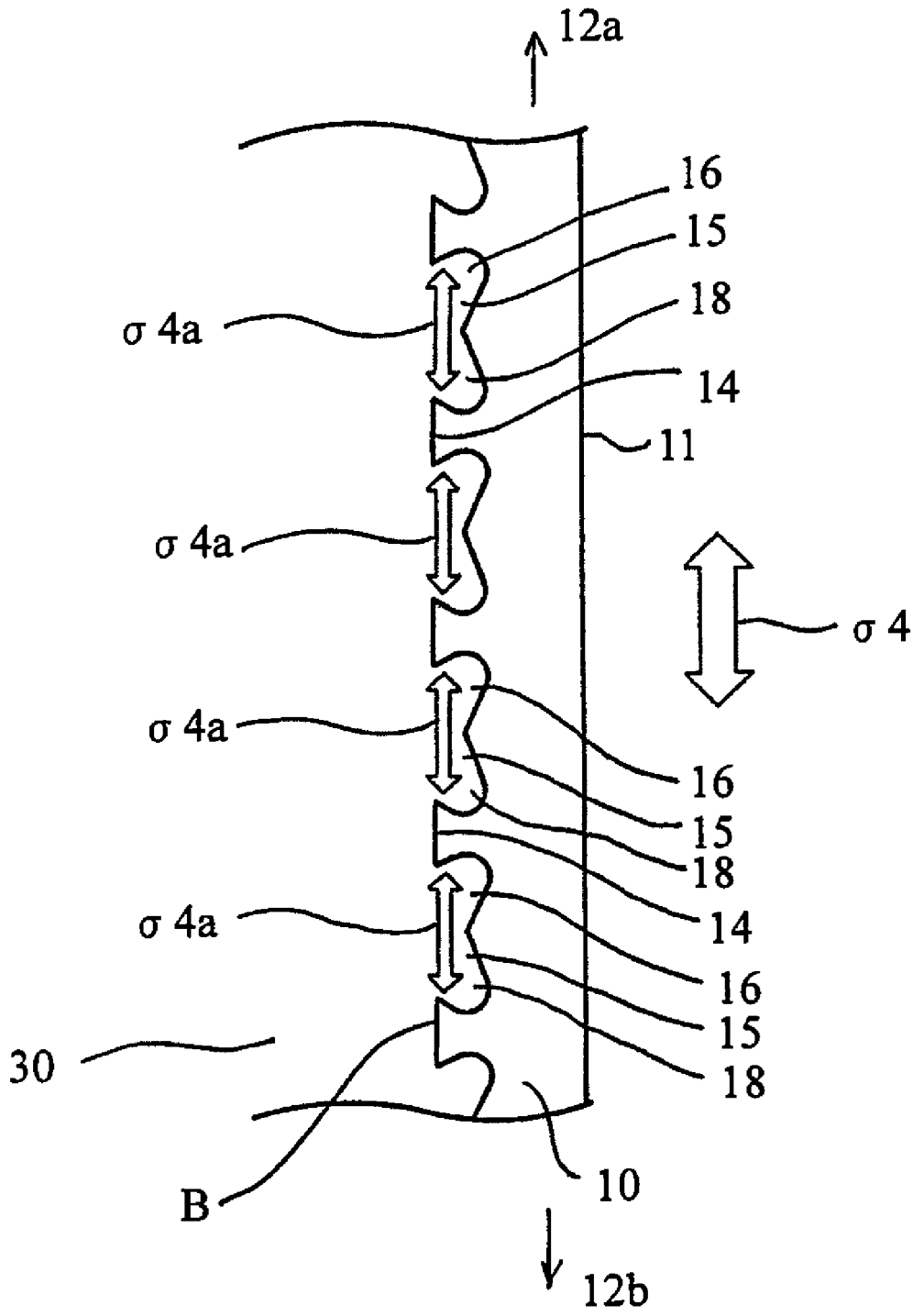
FIG. 10 is a view for explaining axial stress (share stress) acting on the cylinder block according to a first embodiment of the invention.

The circumferential groove 15 formed on the outer circumferential surface 12 of the cylinder liner 10 is formed between the first circumferential groove 16 slanting from a groove bottom in one end 12*a* side in an axial direction of the cylinder liner to an other end 12*b* side in an axial direction and a second circumferential groove 18 slanting from a groove bottom in the other end 12*b* side in an axial direction to the one end 12*a* side in an axial direction symmetrically link to each other with respect to a ridge line 17 and simultaneously is opened between adjacent strip-shaped plane surfaces 14. As shown in FIG. 10, therefore, a partial stress σ4*a* of an axial stress (shear stress) σ4 acting in the axial direction of the cylinder liner 10 by force from a piston acts along the first circumferential groove 16 and second circumferential grooves 18 of the circumferential groove 15 which slants from the one end 12*a* side in an axial direction to the other end 12*b* side in an axial direction and opens between adjacent strip-shaped plane surfaces 14, and the partial stress σ4*a* is received by the circumferential groove 15 to be dispersed throughout interface B between the cylinder liner 10 and the cylinder block main body 30. Thereby close contact at the interface B between the cylinder liner 10 and the cylinder block main body 30 can be ensured and occurrence of gaps can be prevented.

Thus, in a cylinder block 1 prepared in the above-mentioned manner, there is no occurrence of gaps between the cast iron cylinder liner 10 and the cylinder block main body 30 made of aluminum alloy, and simultaneously thermal conductivity between the cast iron cylinder liner 10 and the cylinder block main body 30 becomes uniform in the whole circumference in the axial direction of the cast iron cylinder liner 10 and further the thermal conductivity is enhanced, whereby good cool performance of an engine can be ensured and simultaneously variation of thermal expansion of the cylinder liner 10 can be prevented. As a result, the cylinder liner 10 expands in the form of perfect circle to render an inner surface 11 of a cylinder bore in the form of perfect circle cylinder, whereby friction coefficient of a piston reciprocating within the cylinder bore can be depressed. This depression of friction coefficient between the piston and the cylinder bore brings about reduction of engine oil consumption and simultaneously improvement of fuel consumption, performance and durability of the engine.

Further, the cylinder liner 10 and the cylinder block main body 30 are closely contacted with each other with no gapes at the interface B therebetween to ensure the bonding strength therebetween, and if the load generated when the inner surface 11 of the cylinder bore is machined acts the cylinder liner 10, the processing accuracy by the machining can be ensured owing to depression of the elastic deformation. Furthermore, since there are no gapes at the interface B between the cylinder liner 10 and the cylinder block main body 30, the cylinder liner 10 is prevented from deformation as mentioned above and hence prevented from deterioration with age. Moreover, the close contact at the interface B prevents cooling water from immersing between the cylinder liner 10 and the cylinder block main body 30, and therefore rust development of the cylinder liner 10 can be depressed whereby the cylinder liner 10 can be prevented from the deformation cause by the rust development.

According to the above-mentioned embodiment of the present invention, the contact condition at interface between the cast iron cylinder liner 10 and the cylinder block main body 30 made of aluminum alloy can be stabilized, no gaps are generated at the interface B, and the bonding strength between the cylinder liner 10 and the cylinder block main body 30 is excellent. Thus the cylinder block having high quality as mentioned above can be stably obtained.

Figure 11:
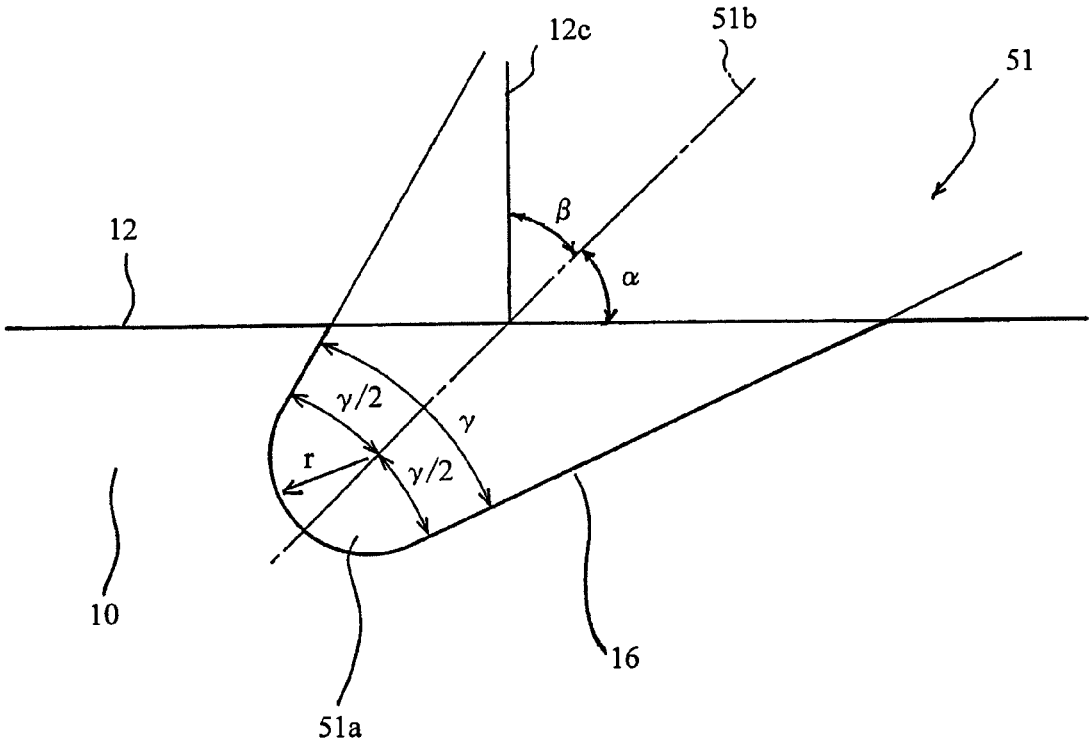
FIG. 11 is a schematic view for explaining a method for processing a circumferential groove of the cylinder liner according to a first embodiment of the invention.
Figure 12:
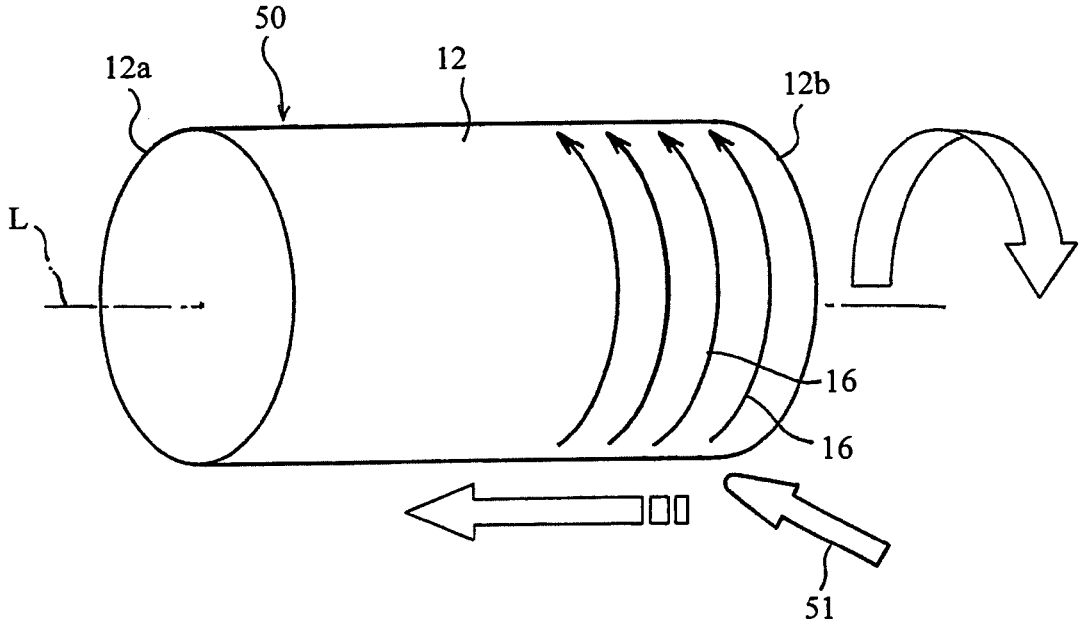
FIG. 12 is a schematic view for explaining a method for processing a circumferential groove of the cylinder liner according to a first embodiment of the invention.
Figure 12:
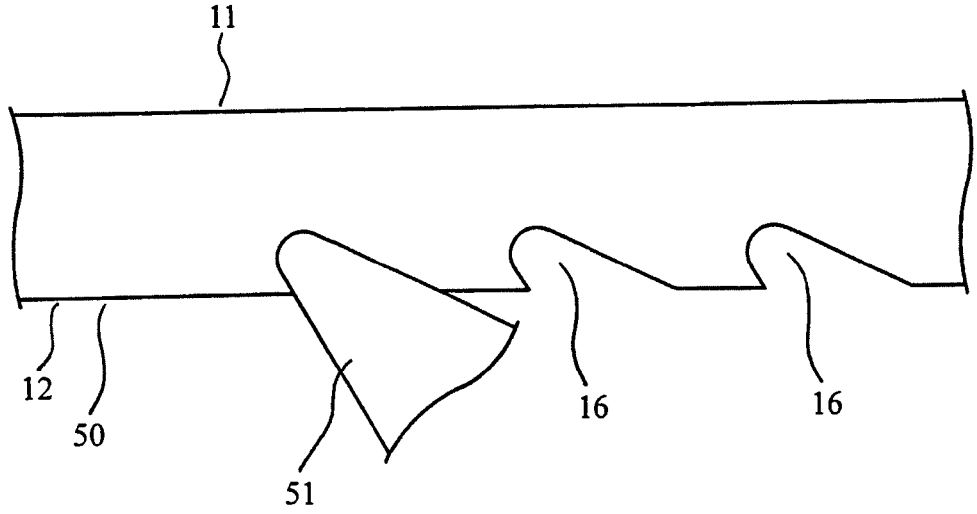
Figure 13:
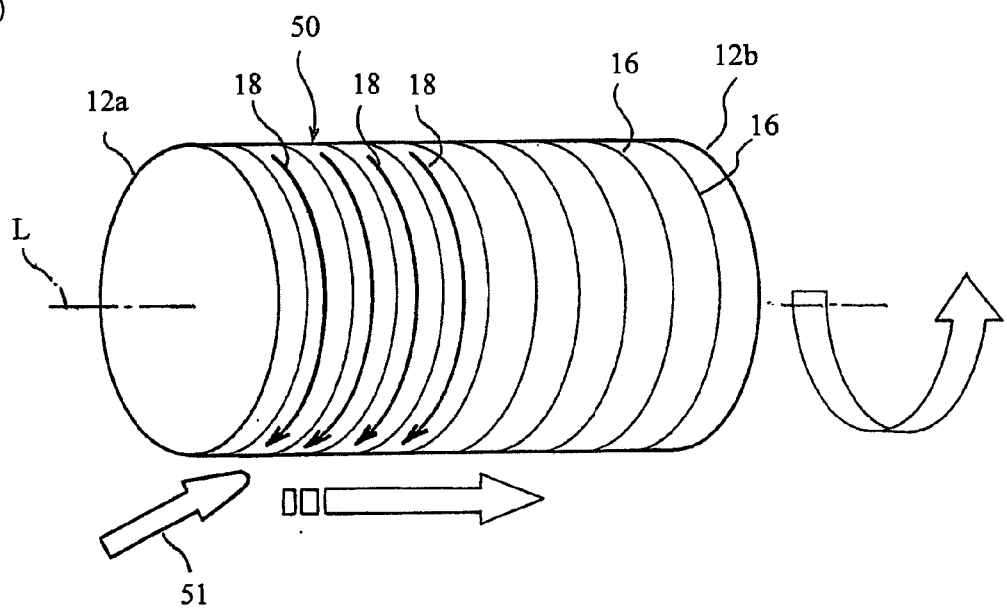
FIG. 13 is a schematic view for explaining a method for processing a circumferential groove of the cylinder liner according to a first embodiment of the invention.
Figure 13:
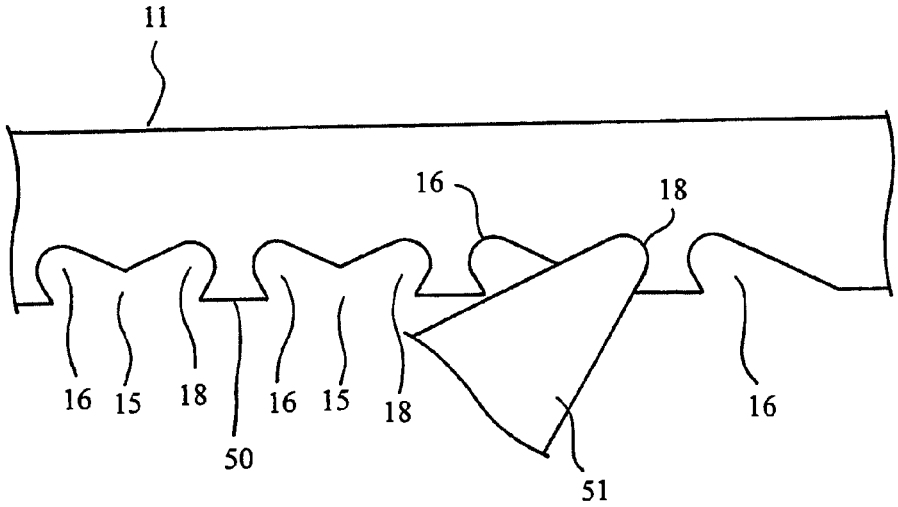

FIGS. 11 to 13 are a schematic view for explaining a process for the preparation of a cylinder liner comprising machining an outer circumferential surface of a cylinder-shaped material by using lathe and the like to form circumferential grooves on the outer circumferential surface.

FIG. 11 shows a relationship between a working tool 51 used for machining the cylinder liner 10 to form a circumferential groove 15 and a first circumferential groove 16, the circumferential groove 15 being composed of the first circumferential groove 16 and the second circumferential groove 18.

A working tool 51 is used for forming undercut of the cylinder liner 10. In an angle between a central axis L and a central line 51*b* of a blade edge (tool) 51*a*, i.e., a cutting blade angle $\alpha$, an angle $\beta$ between a surface 12*c* perpendicular to an outer circumferential surface 12 of the cylinder liner 10 and a central line 51*b* of a blade edge (tool) 51*a*, corresponds to an angle ($\beta>(\gamma/2)$) which is lager than a half of nose angle $\gamma$ of the blade edge (tool) 51*a* of the working tool 51. In more detail, a corner radius r of the blade edge (tool) 51*a* corresponds to a radius of a first curved surface 16*c*, and the nose angle $\gamma$ corresponds to an angle between a first slant surface 16*a* and a second slant surface 16*e*.

The outline of the process is shown in FIG. 12(*a*), and the working tool 51 used on machining is schematically shown in FIG. 12(*b*).

A material 50 of a cylinder liner 10 casted in the form of circular cylinder and having a preliminarily processed inner surface 11 of a cylinder bore is rotated around its central axis L of the material, and a working tool 51 is applied onto an outer circumferential surface of the material 50 at a cutting blade angle $\alpha$ and predetermined intervals p in the axis direction to form circularly a first circumferential groove 16 of each of circumferential grooves 15. In more detail, the cutting brings about;

a taper-shaped first slant surface 16*a* whose diameter is gradually reduced with moving from an outer circumferential end 15*a* corresponding to an edge of a strip-shaped plane surface 14 to one end 12*a* side in an axial direction of the cylinder liner, a first curved surface 16*c* whose diameter is gradually reduced in the form of arc with moving from an inner circumferential end 16*b* of the first slant surface 16*a* and which becomes a first groove bottom, and a taper-shaped second slant surface 16*e* whose diameter is gradually increased with moving from an inner circumferential end 16*d* of the first curved surface 16*c* to the other end 12*b* side in the axial direction of the cylinder liner and which faces the first slant surface 16*a*, these first slant surface 16*a*, first curved surface 16*c* and second slant surface 16*e* being continuously linked to each other in this order to form the first circumferential groove 16 in the form of "J" of the alphabet in sectional view.

The subsequent outline of the process of the material 50 on which first circumferential grooves 16 are cut is shown in FIG. 13(*a*), and the working tool 51 used on cutting is schematically shown in FIG. 13(*b*).

The material 50 is rotated around its central axis, and a working tool 51 is applied onto an outer circumferential surface of the material 50 at a cutting blade angle $\beta$ to cut circularly a second circumferential groove 18 wherein a third slant surface 18*e* continuously links to a second slant surface 16*e* of each of first circumferential grooves 16 at predetermined intervals p in the axis direction. In more detail, the cutting brings about;

a taper-shaped third slant surface 18*e* whose outer circumferential end continuously links to a ridge line 17 corresponding to an outer circumferential end of the second slant surface 16*e* of the first circumferential groove 16 and whose diameter is gradually reduced with moving to the other end 12*b* part side in the axial direction of the cylinder liner, a second curved surface 18*c* whose diameter is gradually increased in the form of arc with moving from an inner circumferential end 18*d* of the third slant surface 18*e* and which becomes a second groove bottom, and a taper-shaped fourth slant surface 18*a* whose diameter is increased with moving from an outer circumference end 18*b* of the second curved surface 18*c* to the one end 12*a* side in the axial direction of the cylinder liner, which faces the third slant surface 18*e* and whose outer circumferential end links to a second outer circumferential end 15*b* corresponding to an edge of an adjacent strip-shaped plane surface 14 existing in an end 12*b* side in an axial direction of the cylinder liner, these third slant surface, second curved surface and fourth slant surface being continuously linked to each other in this order to form a shape of "J" of the alphabet in sectional view. By the cutting, good circumferential grooves 15 can be effectively formed.

(Second Embodiment)

The second embodiment of the present invention is explained by reference of FIGS. 14 to 25.

Figure 14:
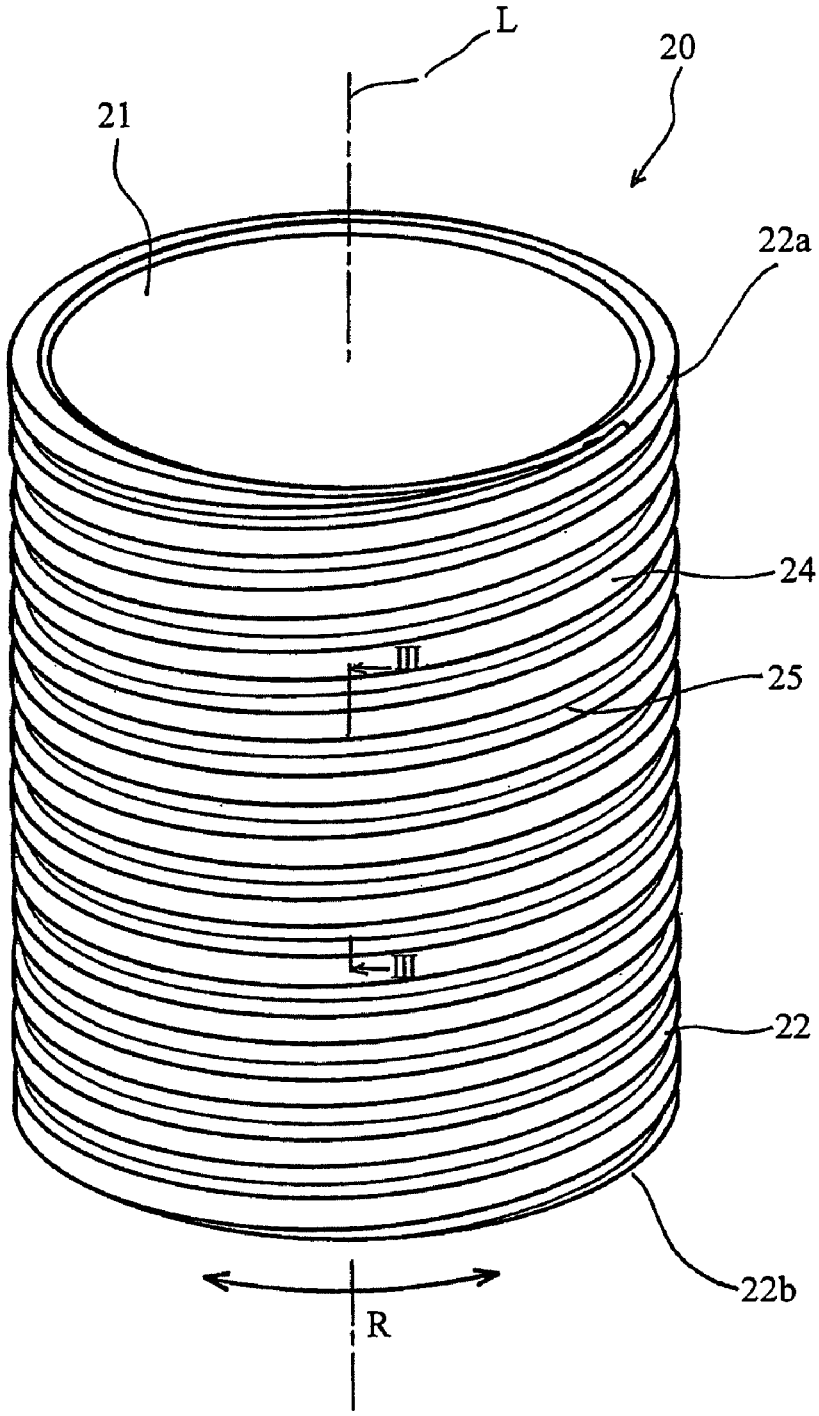
FIG. 14 is a perspective view of a cylinder liner according to a second embodiment of the invention.
Figure 15:
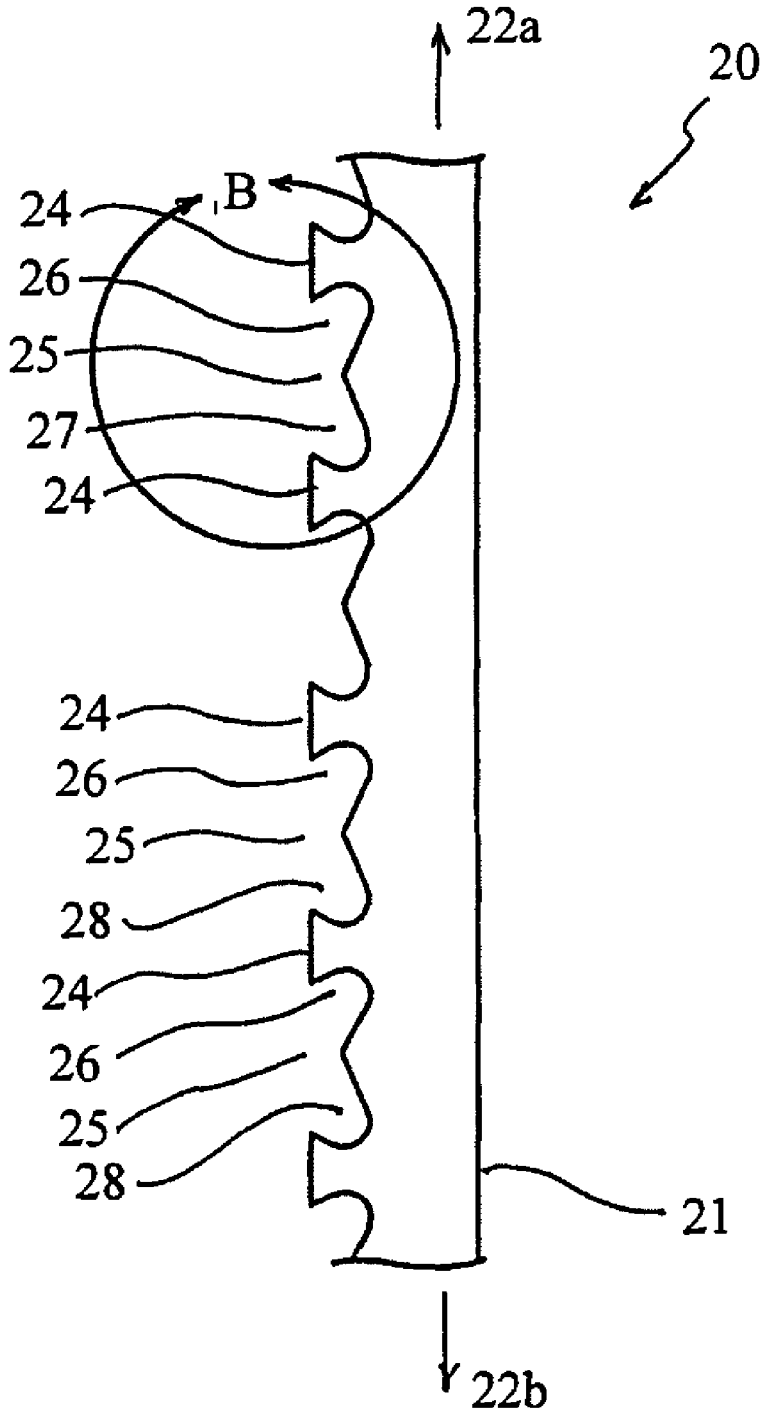
FIG. 15 is an expanded main view of a section view of FIG. 14 by a line III-III.

FIG. 14 is a perspective view of the cylinder liner 20, and FIG. 15 is an expanded main view of a section view of FIG. 14 by a line III-III.

The cylinder liner 20 is cylindrically formed so as to have an inner surface 21 and an outer circumferential surface 22 of a cylinder bore having circular shape in cross-section, which extend in the axial direction centered in a central axis L, as shown in FIGS. 14 and 15. A spiral strip-shaped plane surface 24 extending in the circumferential direction R in parallel to the central axis L throughout the range from the one axial end 22*a* to the other axial end 22*b*, and a circumferential groove 25 spirally extending between the spiral strip-shaped plane surface 24 are formed.

Figure 16:
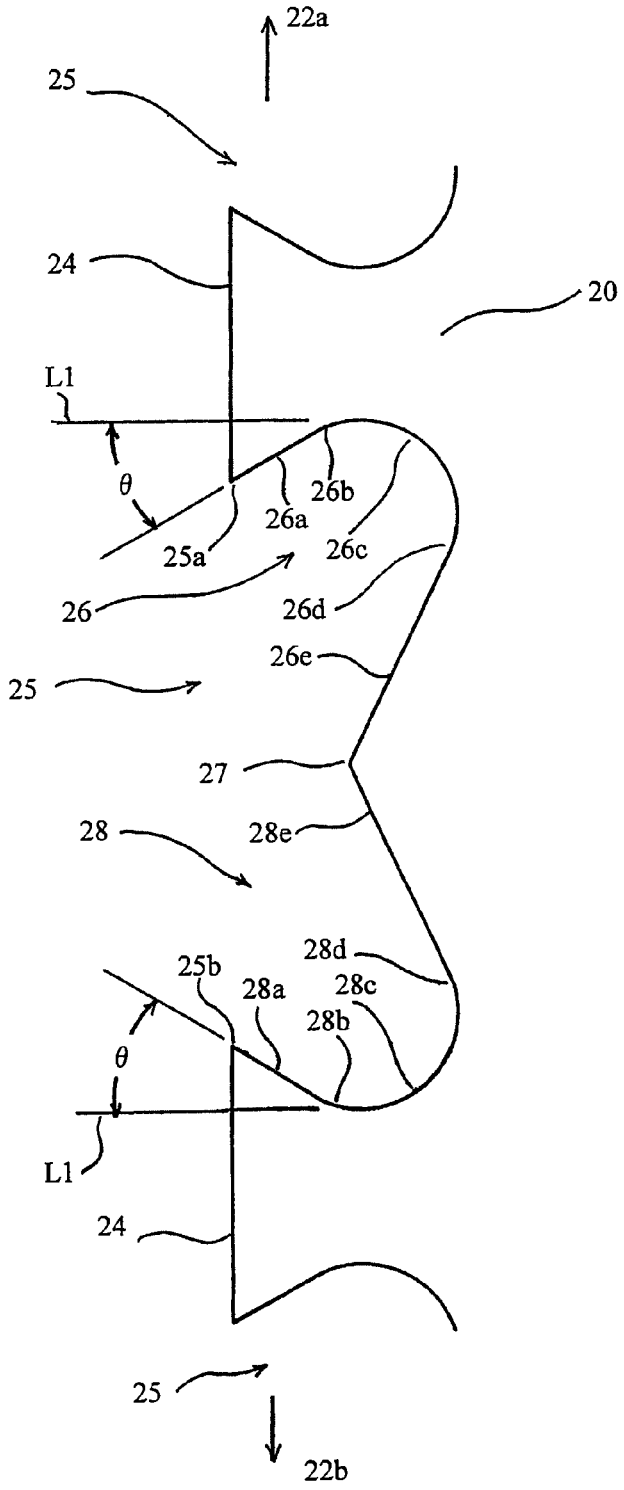
FIG. 16 is an expanded main view of "B" part of FIG. 15.

As shown in FIG. 16 illustrating an expanded main view of "A" part of FIG. 15, the circumferential groove 25 seen in an axial sectional view is formed from a first circumferential groove 26 and a second circumferential groove 28; and the first circumferential groove 26 is composed of a first slant surface 26*a* whose diameter is gradually reduced with moving from an outer circumferential edge 25*a* of a strip-shaped plane surface 24 existing in one end 22*a* side in an axial direction of the cylinder liner to the one end 22*a* side in the axial direction to form a taper shape, a first curved surface 26*c* whose diameter is gradually reduced in the form of arc with moving from an inner circumference end 26*b* of the first slant surface 26*a* and which becomes a first groove bottom, and a second slant surface 26*e* whose diameter is gradually increased with moving from an inner end 26*d* of the first curved surface 26*c* to the other end 22*b* side in the axial direction of the cylinder liner to form a taper shape and which faces the first slant surface 26*a*, these first slant surface 26*a*, first curved surface 26*c* and second slant surface 26*e* being continuously linked to each other in this order to form a shape of "J" of the alphabet in sectional view; and the second circumferential groove 18 is composed of a third slant surface 28*e* which continuously links to a ridge line 27 corresponding to an outer circumference end of the second slant surface 26*e* and whose diameter is gradually reduced with moving to the other end 22*b* side in the axial direction of the cylinder liner to form a taper shape, a second curved surface 28*c* whose diameter is gradually increased in the form of arc with moving from an inner circumference end 28*d* of the third slant surface 28*e* and which corresponds to a second groove bottom, and a fourth slant surface 28*a* whose diameter is gradually increased with moving from an outer circumference end 28*b* of the second curved surface 28*c* to the one end 22*a* side in the axial direction of the cylinder liner, which faces the third curved surface 28*e* and whose outer circumference end links in the form of taper to a second outer circumferential end 25*b* corresponding to an edge of a strip-shaped plane surface 24 existing in an end 22*b* side in an axial direction of the cylinder liner, these third slant surface 28*e*, second curved surface 28*c* and fourth slant surface 28*a* being continuously linked to each other in this order to form a shape of "J" of the alphabet in sectional view; the first circumferential groove 26 and the second circumferential groove 28 being symmetrically placed with respect to the ridge line 27.

The first slant surface 26*a* and the fourth slant surface 28*a* have a slant angle θ of 3° to 35° (degree) with respect to a radial reference line L1 perpendicular to a central axis L, and the areas of the first slant surface 16*a* and the fourth slant surface 18*a* form an undercut (portion undercutting a support portion of a strip-shaped plane surface). In more detail, a first circumferential groove 26 slanting from a groove bottom in one end 22*a* side in an axial direction of the cylinder liner to an other end 22*b* side in an axial direction and a second circumferential groove 28 slanting from a groove bottom in the other end 22*b* side in an axial direction to the one end 22*a* side in an axial direction link to each other with respect to a ridge line 27 to form a spiral circumferential groove 25, which opens between adjacent strip-shaped plane surfaces 24.

Figure 17:
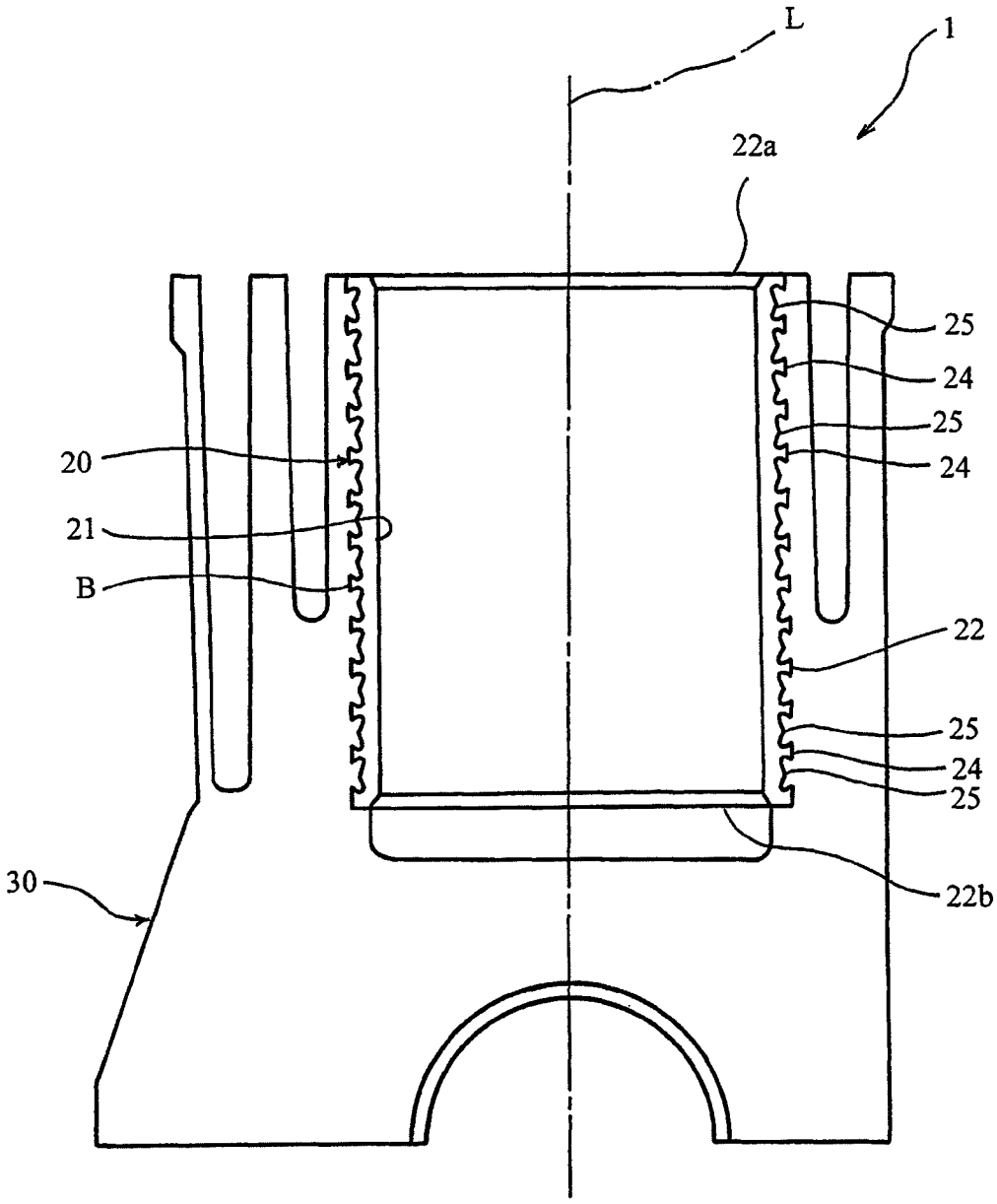
FIG. 17 is a section view of a cylinder block according to a second embodiment of the invention.

A resultant cylinder liner 20 is subjected to an enclosing-casting process in the same manner as the first embodiment. A plurality of cylinder liners 20 (two cylinder liners in this embodiment) are placed in parallel in a mold, and enclosed by casting a molten aluminum alloy, whereby a cylinder block 1 can be obtained, wherein cylinder liners 20 enclosed in a cylinder block main body 30 of an aluminum alloy and the cylinder block main body 30 are integrated, as shown in FIG. 17.

Figure 18:
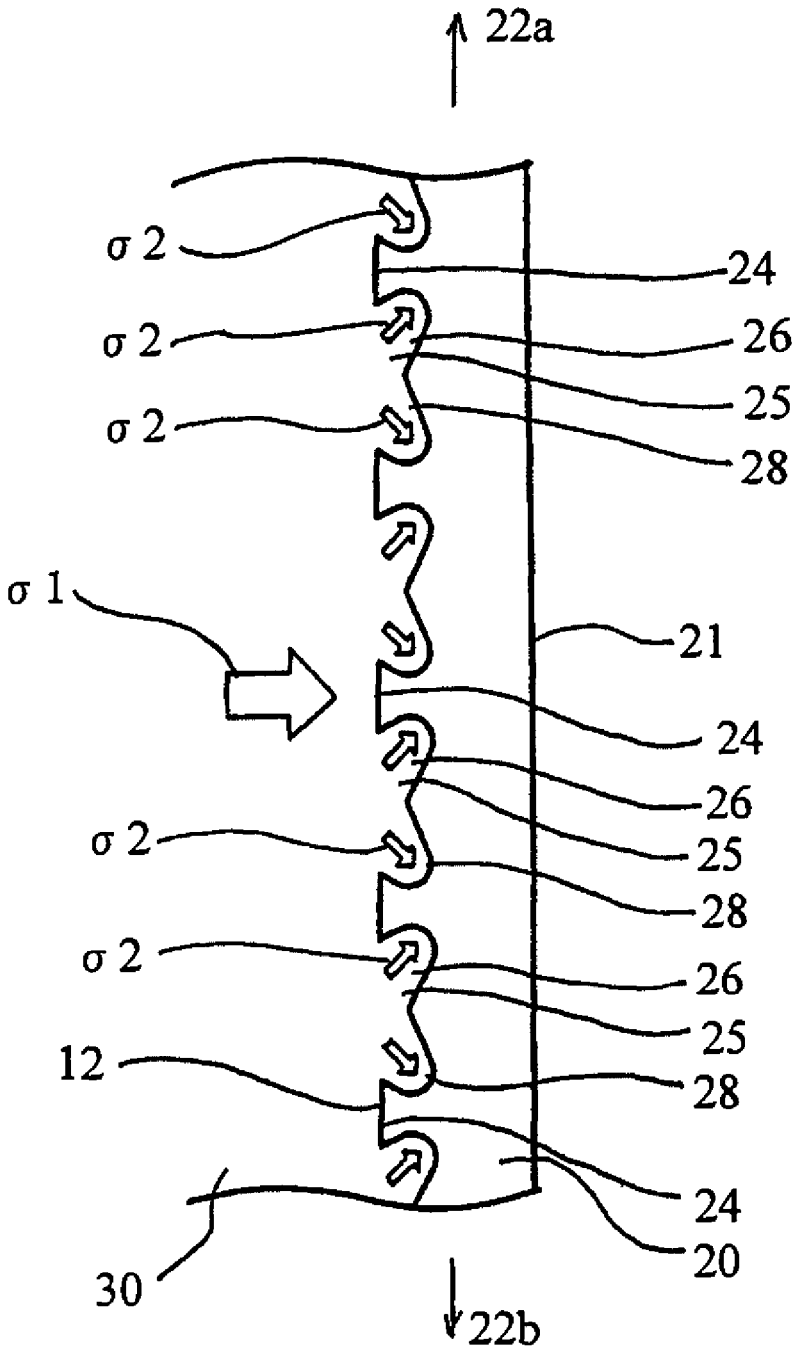
FIG. 18 is a view for explaining action of shrinkage stress generated by the solidification and shrinkage of a molten aluminum alloy according to a second embodiment of the invention.

A circumferential groove 25 spirally extending from one end 22*a* side in an axial direction to the other end 22*b* side in an axial direction is formed such that a first circumferential groove 26 slanting from a groove bottom on the one end 22*a* side in an axial direction to the other end 22*b* side in an axial direction, and a second circumferential groove 28 slanting from a groove bottom on the other end 22*b* side in an axial direction to the one end 22*a* side in an axial direction are linked to each other with respect to a ridge line 27 and the circumferential groove 25 is opened between adjacent strip-shaped plane surface(s) 24. Therefore, in the enclosing-casting process, a molten aluminum alloy is flowed in the circumferential groove 25, and on the solidification and shrinkage of the molten aluminum alloy enclosing the cylinder liner, a shrinkage stress σ1 acts in the direction perpendicular to a strip-shaped plane surface 24 and simultaneously an axial shrinkage generated together with the solidification is equally received by first circumferential groove 26 and second circumferential groove 28 of the circumferential groove 25 formed on the circumferential surface 22 of the cylinder liner 20 to depress the molten aluminum alloy from moving in an axial direction, as shown in FIG. 18. Thereby, an axial shrinkage stress σ2 generated on the solidification and shrinkage of the molten aluminum alloy is equally dispersed along the circumferential surface 22 of the cylinder liner 20, and therefore a residual stress generated in the aluminum alloy after shrinkage can be reduced and equally dispersed. The reduction and equalization relax a residual stress of the cylinder block main body 30. In more detail, the residual stress of the cylinder block main body 30, particularly a thin-walled portion 31 thereof formed between adjacent cylinder liners 20, is relaxed whereby the cylinder block main body 30 can be prevented from breaking (cracking).

Figure 19:
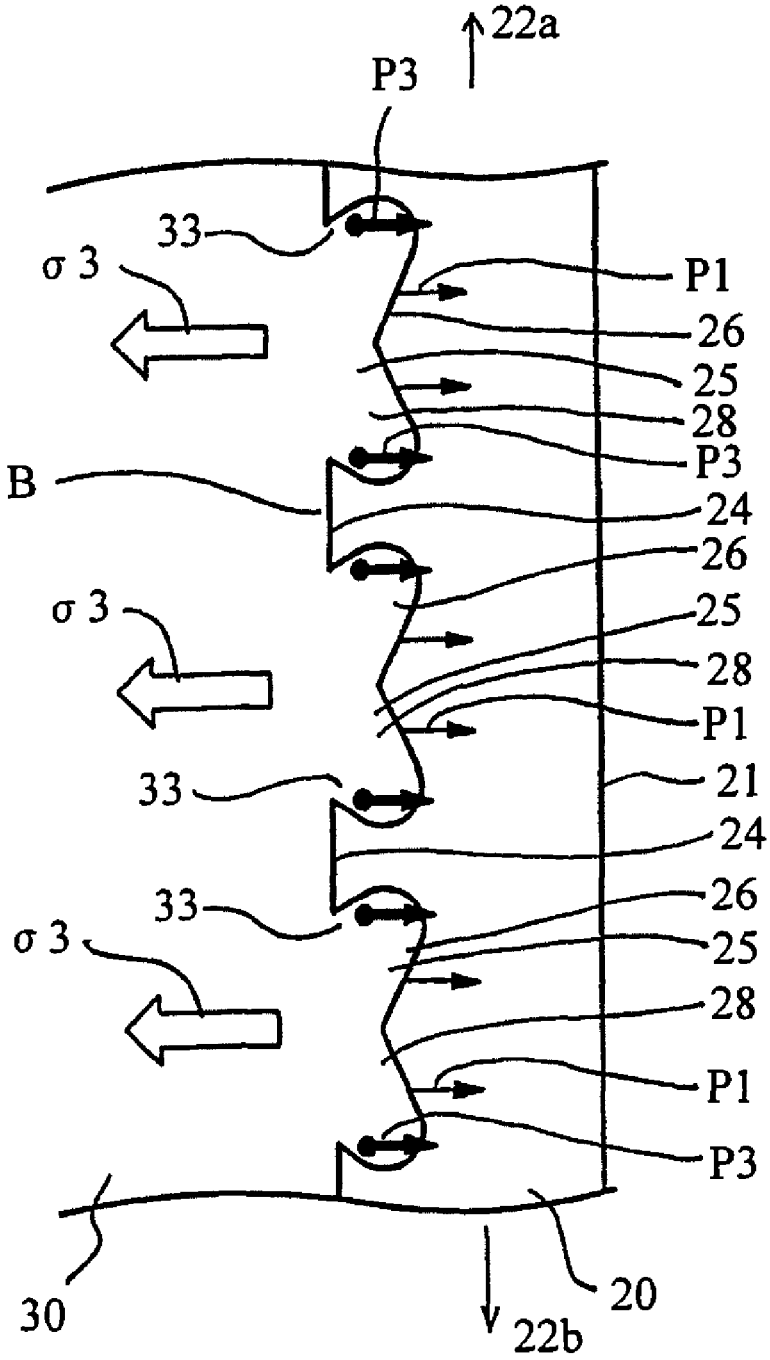
FIG. 19 is a view for explaining peeling stress acting on the cylinder block according to a second embodiment of the invention.
Figure 20:
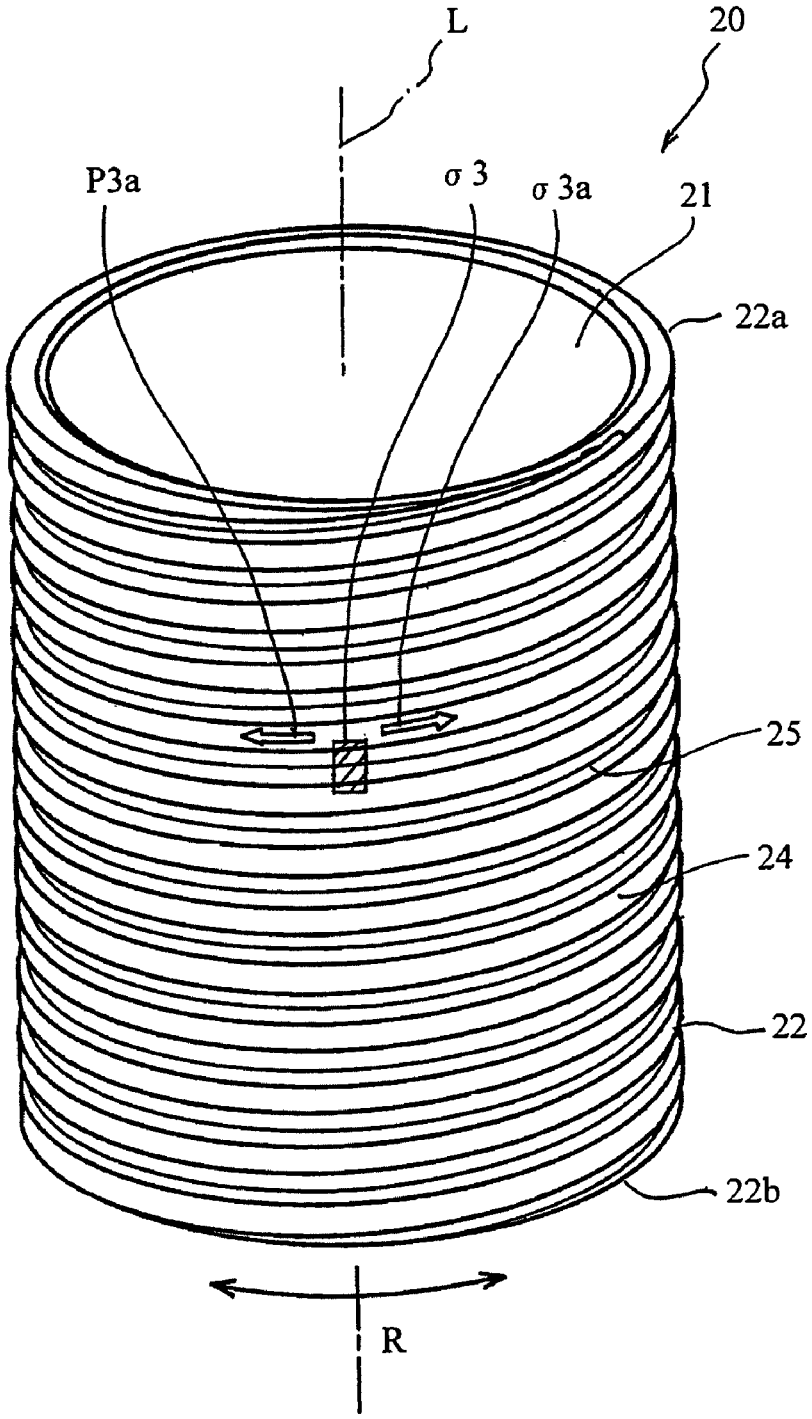
FIG. 20 is a view for explaining circumferential stress acting on the cylinder block according to a second embodiment of the invention.

A residual stress and thermal expansion difference generated on the solidification and shrinkage the molten aluminum alloy enclosing the cast iron cylinder liner 20 give a high stress to the cylinder block main body 30 made of the molten aluminum alloy enclosing the cast iron cylinder liner 20 as shown in FIG. 19, and hence a peeling stress σ3 is occasionally generated in the direction peeling the cylinder block main body 30 from the circumferential surface 22 of the cylinder liner 20. A part of the peeling stress σ3 is dispersed as a circumferential stress σ3*a* along the direction that the circumferential groove 25 extends, as shown in FIG. 20 illustrating a perspective view for explaining circumferential stress omitting the cylinder block main body 30.

A portion 33 of the cylinder block main body 30 flowed into the circumferential groove 25 of the cylinder liner 20 is received by the first circumferential groove 26 and second circumferential grooves 28 of the circumferential groove 25 of the cylinder liner 20, particularly the ranges of from an approximate outer circumferential end of the undercut first curved surface 26*c* to the first slant surface 26*a* and from an approximate outer circumferential end of the second curved surface 28*c* to the fourth slant surface 28*a*, whereby a drag P3 acts against the peeling stress σ3. Hence, a close contact force P1 between the cylinder liner 20 and the cylinder block main body 30 is ensured, and therefore occurrence of gaps can be prevented at interface B between the cylinder liner 20 and the cylinder block main body 30.

Further, a circumferential drag P3 operating in the direction opposite to the circumferential stress σ3*a* acts against the circumferential stress σ3*a*, whereby the movement of the stress in the circumferential direction R along the outer circumferential surface 22 of the cylinder liner 20 is depressed and a shear stress in the circumferential direction generated at interface B between the cylinder liner 20 and cylinder block main body 30 is depressed, which enables prevention of occurrence of gaps at interface B between the cylinder liner 20 and cylinder block main body 30.

Figure 21:
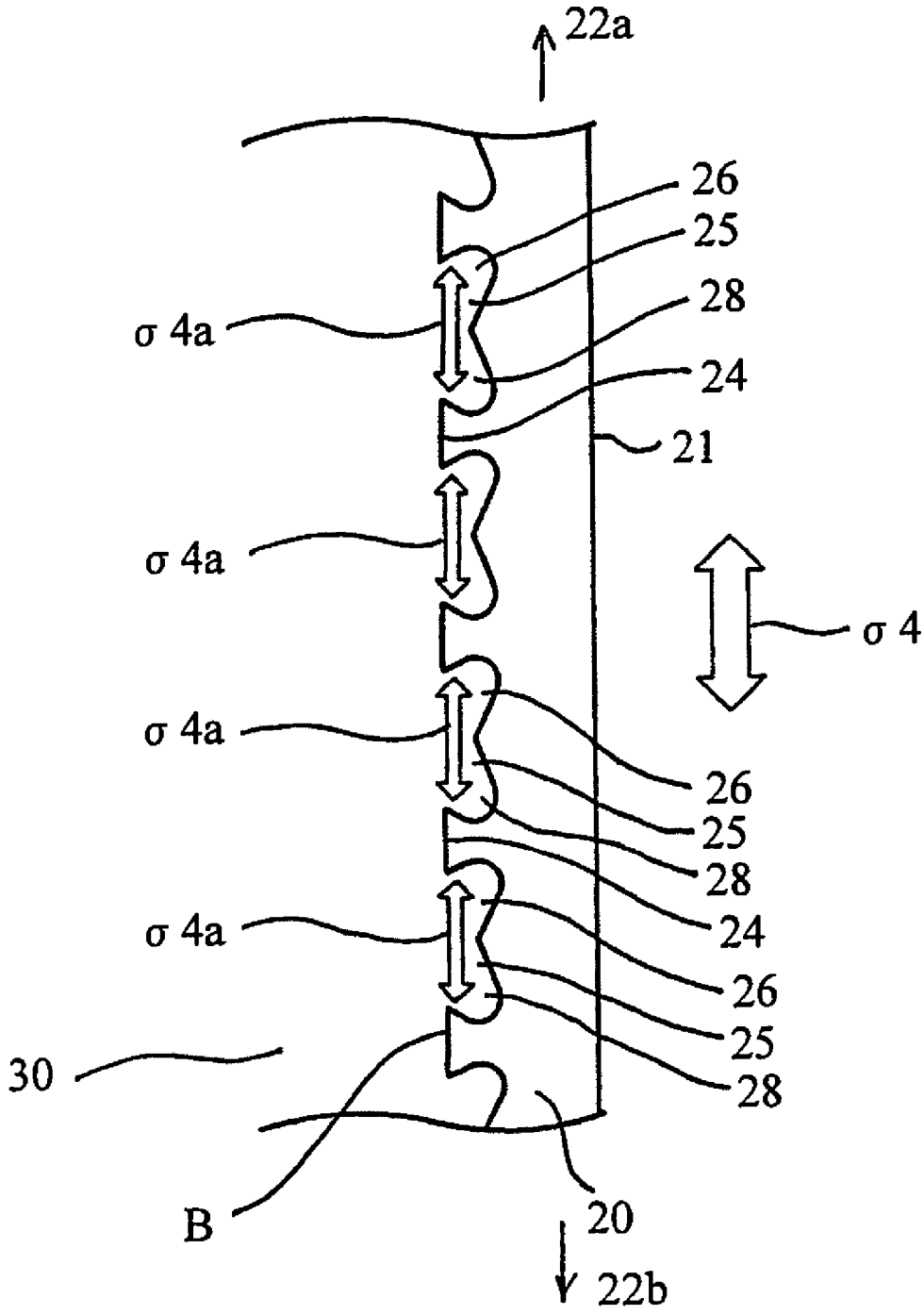
FIG. 21 is a view for explaining axial stress (share stress) acting on the cylinder block according to a second embodiment of the invention.

Furthermore, as shown in an explanation view of FIG. 21, a partial stress σ4*a* of an axial stress (shear stress) σ4 acting in the axial direction of the cylinder liner 20 by a piston and the like acts along a first circumferential groove 26 and a second circumferential groove 28 of a circumferential groove 25 which slants in the directions of an axial one end 22*a* and an axial other end 22*b* and which opens between an strip-shaped plane surface 24, and hence the axial stress σ4 is received by the circumferential groove and dispersed throughout interface B between the cylinder liner 20 and cylinder block main body 30. Thus, the close contact at interface B between the cylinder liner 20 and cylinder block main body 30 can be ensured, and the occurrence of gaps at interface B can be prevented.

Figure 22:
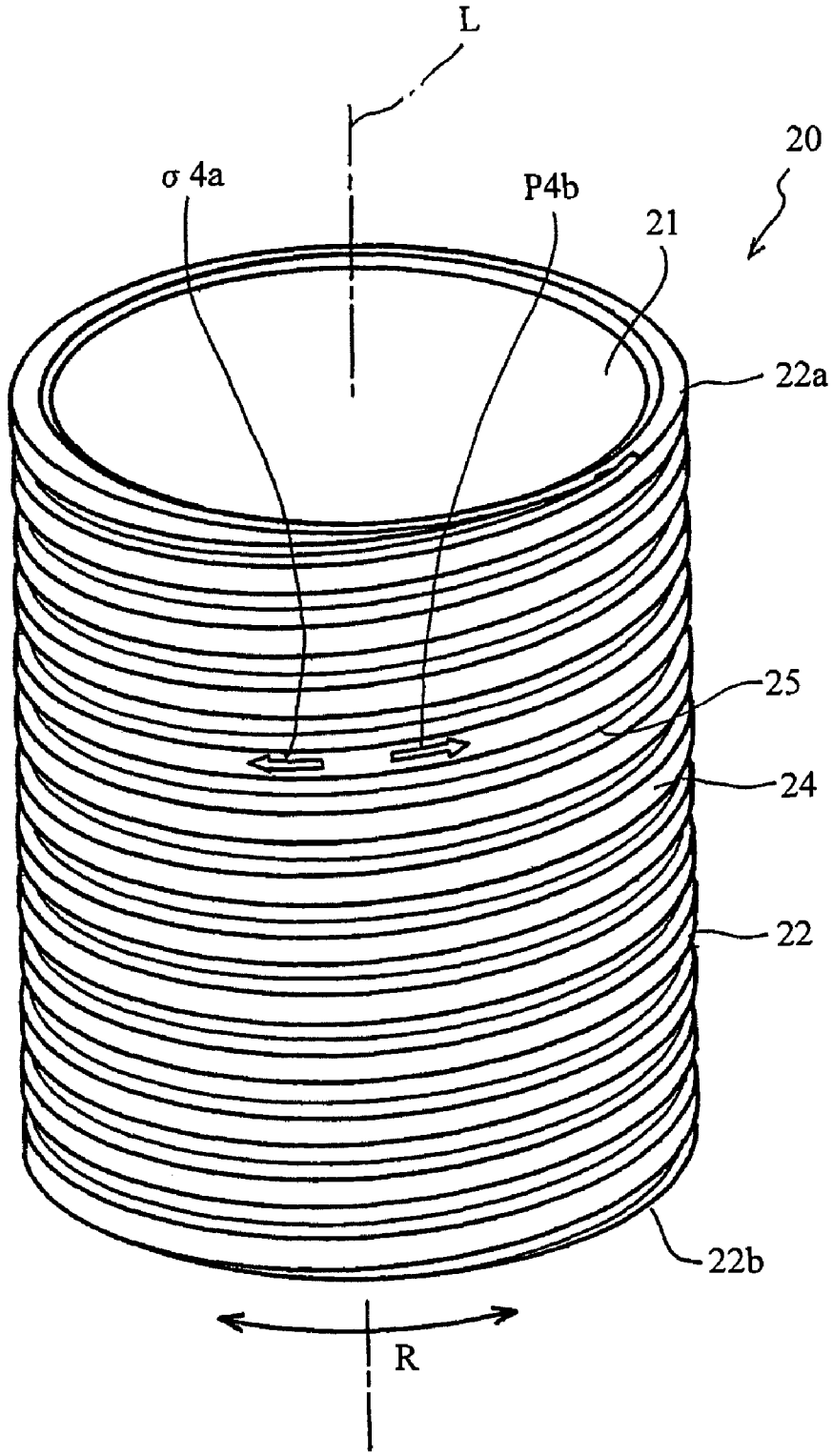
FIG. 22 is a view for explaining axial stress (share stress) acting on the cylinder block according to a second embodiment of the invention.

Moreover, as shown in FIG. 22 illustrating a perspective view for explaining circumferential stress omitting the cylinder block main body 30, a part of the axial stress σ4 is dispersed as a circumferential stress σ4*b* along the direction that the circumferential groove 25 extends, whereas a drag P4*b* operating in the direction opposite to the circumferential stress σ4*b* acts the circumferential stress σ4*b*. Thereby, the movement of the stress in the circumferential direction R along the outer circumferential surface 22 of the cylinder liner 20 is depressed and a shear stress in the circumferential direction generated at interface B between the cylinder liner 20 and cylinder block main body 30 is depressed, which enables prevention of occurrence of gaps at interface B between the cylinder liner 20 and cylinder block main body 30.

In the cylinder block prepared above, the contact condition at interface B between the cast iron cylinder liner 20 and the cylinder block main body 30 made of aluminum alloy is stabilized, no gaps are generated at the interface B and the bonding strength between the cylinder liner 20 and the cylinder block main body 30 is excellent, as in the first embodiment. Thus the cylinder block 1 having high quality as mentioned above can be stably obtained.

Further, a circumferential groove continuously formed spirally on the outer circumferential surface 22 of the cylinder liner 20 is prepared as follows; a cylinder liner material casted in the form of circular cylinder is rotated around its central axis L, and a working tool is applied onto an outer circumferential surface 22 of the material with moving along the central axis direction to mechanically form a spiral first circumferential groove 26, and then the cylinder liner material is rotated around its central axis in a direction opposite to the above-mentioned rotating direction, and a working tool is applied onto an outer circumferential surface of the material with moving the tool in the direction opposite to the above direction to cut a second circumferential groove 28 wherein a third slant surface 28*e* extends to a second slant surface 26*e* of the first circumferential groove 26. Hence, the preparation of the spiral circumferential groove can be effectively performed, and is improved in productivity and reduction of production cost, compared with the process for forming groove by intermittent processing according to the first embodiment.

Figure 23:
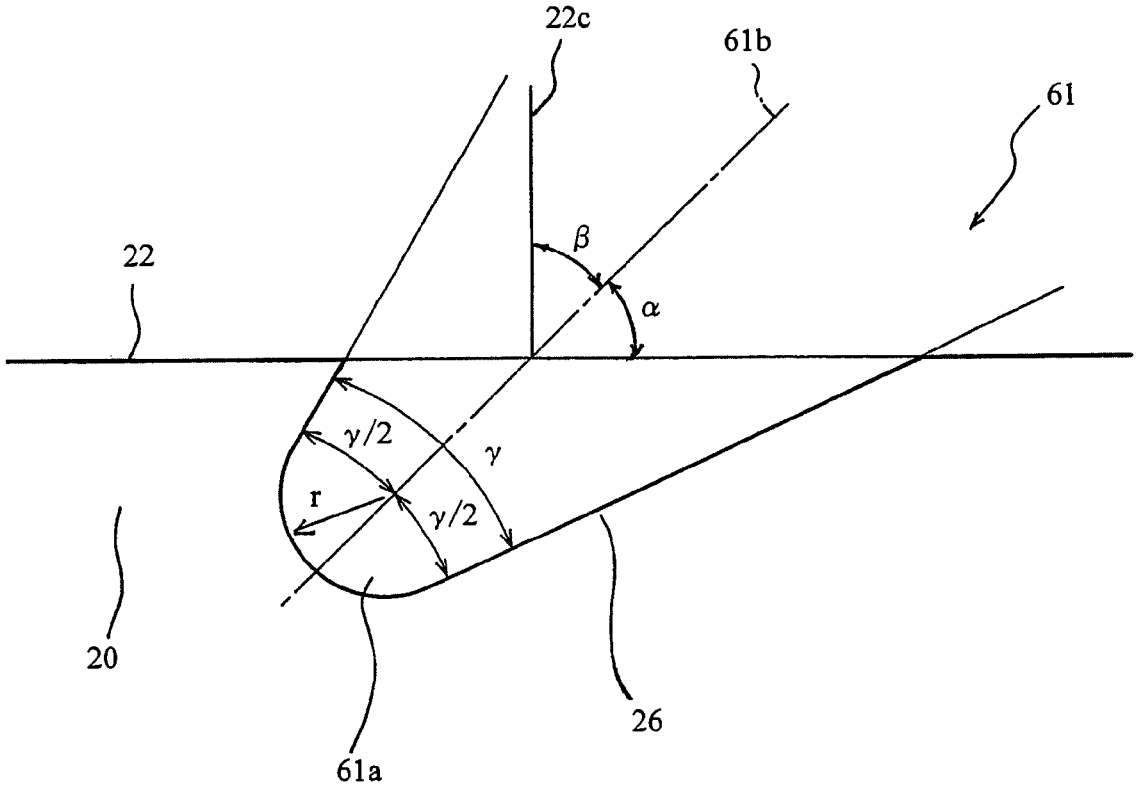
FIG. 23 is a schematic view for explaining a method for processing a circumferential groove of the cylinder liner according to a second embodiment of the invention.
Figure 24:
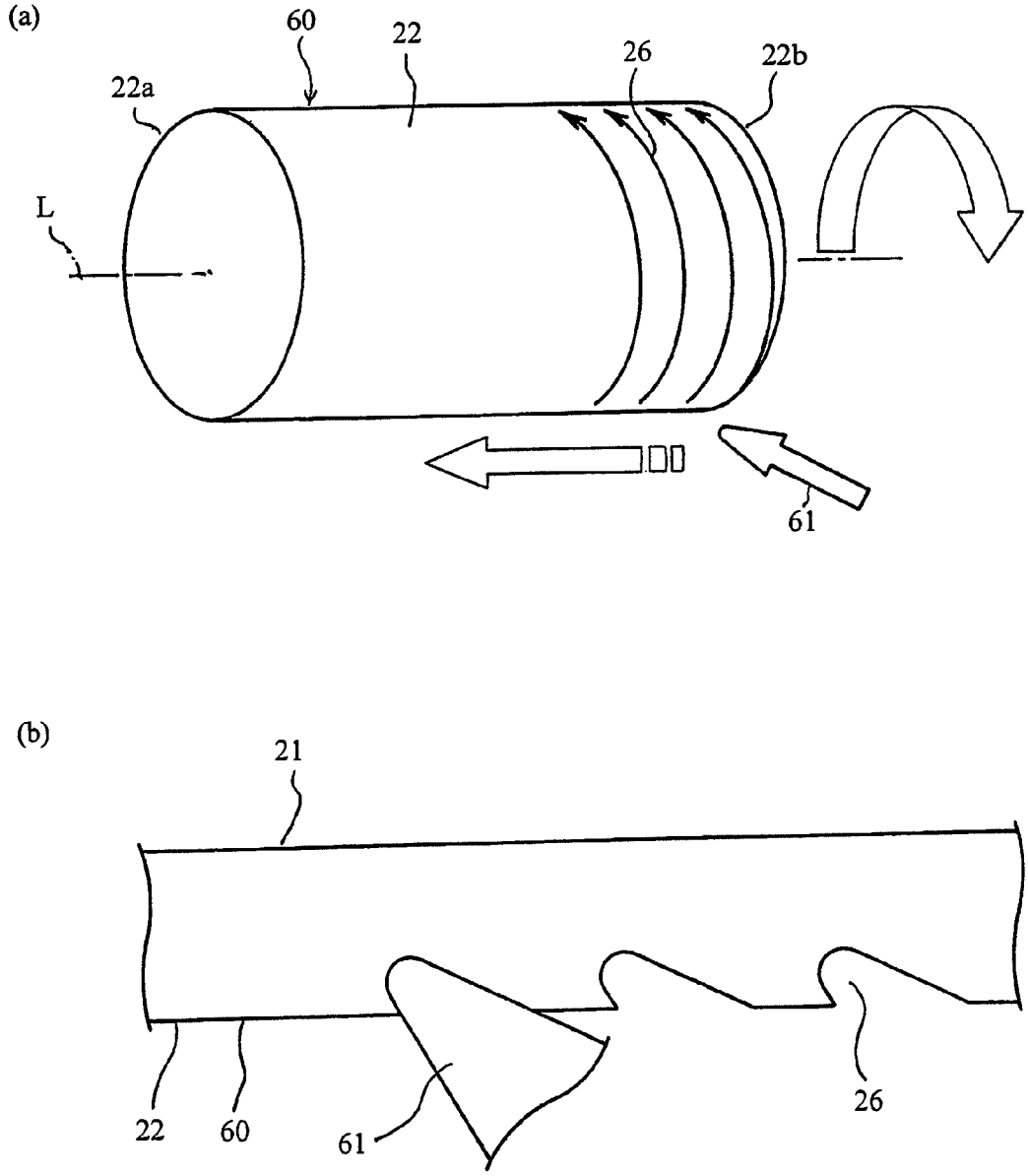
FIG. 24 is a schematic view for explaining a method for processing a circumferential groove of the cylinder liner according to a second embodiment of the invention.
Figure 25:
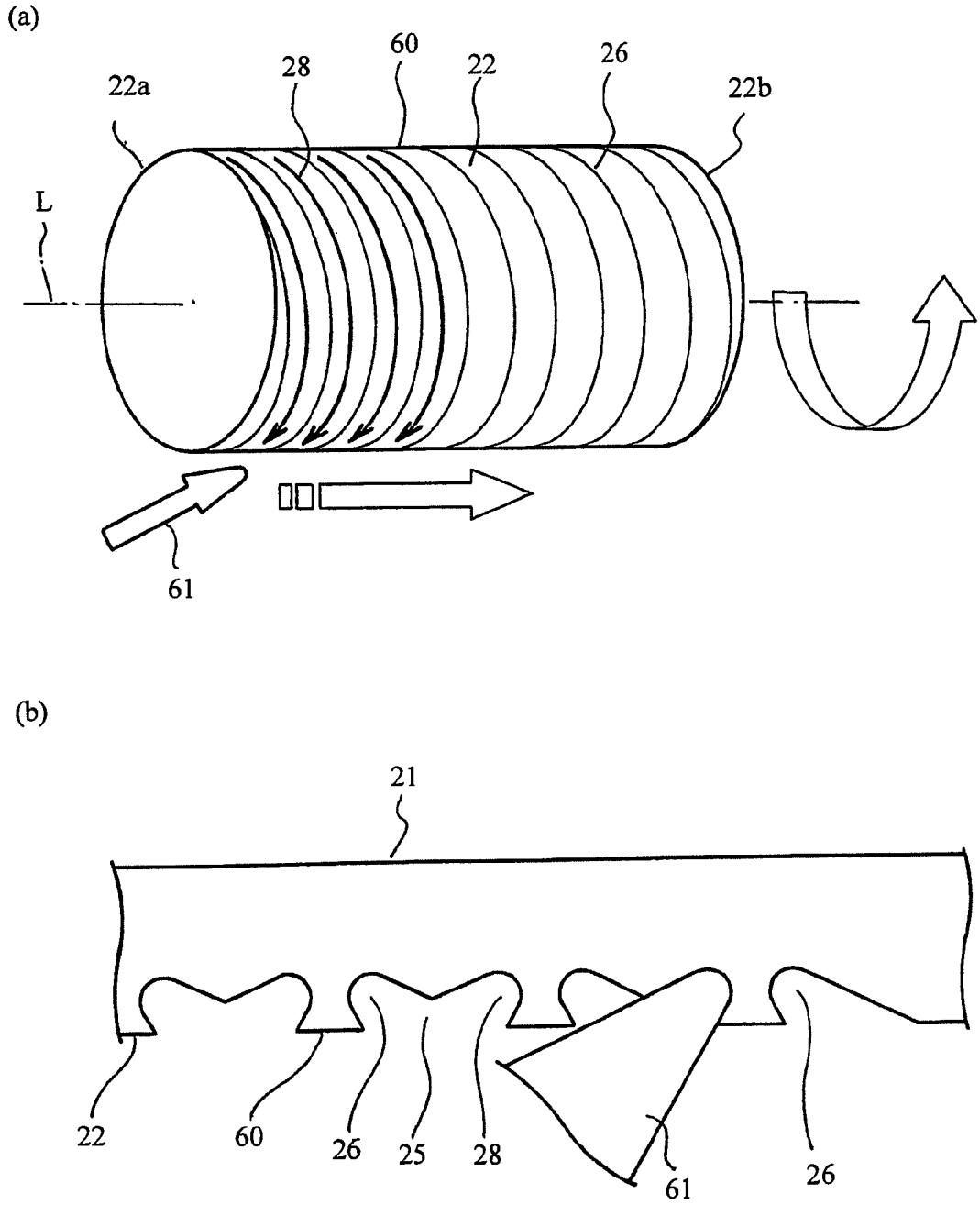
FIG. 25 is a schematic view for explaining a method for processing a circumferential groove of the cylinder liner according to a second embodiment of the invention.

The outline of the process for forming circumferential groove of the cylinder liner is explained by referring to FIGS. 23 to 25.

FIG. 23 shows a relationship between a working tool 61 used for machining the cylinder liner 20 to form a circumferential groove 25 and a second circumferential groove 28, the circumferential groove 25 being composed of the first circumferential groove 26 and the second circumferential groove 28.

A working tool 61 is used for forming undercut of the cylinder liner 20. In an angle between a central axis L and a central line 61*b* of a blade edge (tool) 61*a*, i.e., a cutting blade angle α, an angle β between a surface 22*c* perpendicular to an outer circumferential surface 22 of the cylinder liner 20 and a central line 61*b* of a blade edge (tool) 61*a*, corresponds to an angle (β>(γ/2)) which is lager than a half of nose angle γ of the blade edge (tool) 61*a* of the working tool 61. In more detail, a corner radius r of the blade edge (tool) 61*a* corresponds to a radius of a first curved surface 26*c*, and the nose angle γ corresponds to an angle between a first slant surface 26*a* and a second slant surface 26*e*.

The outline of the process is shown in FIG. 24(*a*), and the working tool 61 used in processing (machining) is schematically shown in FIG. 24(*b*).

A material 60 of a cylinder liner 20 casted in the form of circular cylinder and having a preliminarily processed inner surface 21 of a cylinder bore is rotated around its central axis L, and a working tool 61 is applied onto an outer circumferential surface of the material 60 at a cutting blade angle, a predetermined feeding speed and predetermined intervals p in the axis direction from the other axial end 22*b* side to the one axial end 22*a* side to spirally form a first circumferential groove 26. In more detail, the cutting brings about;

a taper-shaped first slant surface 26*a* whose diameter is gradually reduced with moving from an outer circumferential end 25*a* corresponding to an edge of a strip-shaped plane surface 24 to one axial end 22*a* side of the cylinder liner, a first curved surface 26*c* whose diameter is gradually reduced in the form of arc with moving from an inner circumferential end 26*b* of the first slant surface 26*a* and which becomes a first groove bottom, and a taper-shaped second slant surface 26*e* whose diameter is gradually increased with moving from an inner circumferential end 26*d* of the first curved surface 26*c* to the other axial end 22*b* side and which faces the first slant surface 26*a*, these first slant surface 26*a*, first curved surface 26*c* and second slant surface 26*e* being continuously linked to each other in this order to form the first circumferential groove 26 in the form of "J" of the alphabet in sectional view.

The subsequent outline of the process of the material 60 on which first circumferential groove 26 is cut is shown in FIG. 25(*a*), and the working tool 61 used on cutting is schematically shown in FIG. 25(*b*).

The material 60 is rotated around its central axis in the direction opposite to the above, and a working tool 61 is applied onto an outer circumferential surface of the material 60 at a cutting blade angle α in the direction opposite to the above to form a second circumferential groove 28.

In more detail, the cutting brings about the second circumferential groove 28 that the third slant surface 28*e* links to the second slant surface 26*e* of the second circumferential groove 28 with moving from one axial end 22*a* side to the other axial end 22*b* side; in more detail, the second circumferential groove 28 comprises:

a taper-shaped third slant surface 28*e* whose outer circumferential end continuously links to a ridge line 27 corresponding to an outer circumferential end of the second slant surface 26*e* and whose diameter is gradually reduced with moving to the other axial end 22*b*, a second curved surface 28*c* whose diameter is gradually increased in the form of arc with moving from an inner circumference end 28*d* of the third slant surface 28*e* and which becomes a second groove bottom, and a taper-shaped fourth slant surface 28*a* whose diameter is increased with moving from an outer circumference end 28*b* of the second curved surface 28*c* to the one axial end 22*a* side, which faces the third slant surface 28*e* and whose outer circumference end links to a second outer circumferential end 25*b* corresponding to an edge of an adjacent strip-shaped plane surface 24 existing in an axial end 22*b* side, these third slant surface 28*e*, second curved surface 28*c* and fourth slant surface 28*a* being continuously linked to each other in this order to form a shape of "J" of the alphabet in sectional view. By the cutting, good circumferential grooves 25 can be effectively formed.

What is claimed is:

1. A cast iron cylinder liner having a shape of cylinder hollow to be enclosed in a cylinder block main body made of aluminum alloy by enclosing-casting method, which comprises a plurality of strip-shaped plane surfaces circularly extending in a circumferential direction of the cylinder liner, the circular strip-shaped plane surfaces being formed on an outer circumferential surface of the cylinder liner at intervals in the axis direction, and a plurality of circumferential grooves extending in the circumferential direction, the circumferential grooves being formed between the adjacent strip-shaped plane surfaces, each of the circumferential grooves of the cylinder liner in an axial sectional view comprising:

a first circumferential groove comprising, a first slant surface whose diameter is gradually reduced with moving from an outer circumferential edge of a strip-shaped plane surface existing in one end side in an axial direction of the cylinder liner to an inner circumferential end to undercut a support portion of the strip-shaped plane surface, a first curved surface whose diameter is gradually reduced with moving from the inner circumferential end of the first slant surface, and a second slant surface whose diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and a second circumferential groove comprising, a third slant surface which continuously links to an outer circumferential end of the second slant surface and whose diameter is gradually reduced with moving to the other end side in the axial direction of the cylinder liner, a second curved surface whose diameter is gradually increased with moving from an inner circumferential end of the third slant surface, and a fourth slant surface whose diameter is increased with moving from an outer circumferential end of the second curved surface to the one end side in the axial direction of the cylinder liner, which faces the third slant surface and whose outer circumference end links to an outer circumferential end of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

2. A cast iron cylinder liner having a shape of cylinder hollow to be enclosed in a cylinder block main body made of aluminum alloy by enclosing-casting method, which comprises a strip-shaped plane surface spirally extending in a circumferential direction of the cylinder liner, the spiral strip-shaped plane surface being formed on an outer circumferential surface of the cylinder liner at intervals in the axis direction, and a circumferential groove spirally and continuously formed between the spiral strip-shaped plane surface, the circumferential groove of the cylinder liner in an axial sectional view comprising:

a first circumferential groove comprising, a first slant surface whose diameter is gradually reduced with moving from an outer circumferential edge of a strip-shaped plane surface existing in one end side in an axial direction of the cylinder liner to an inner circumferential end to undercut a support portion of the strip-shaped plane surface, a first curved surface whose diameter is gradually reduced with moving from the inner circumferential end of the first slant surface, and a second slant surface whose diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in section view;

and a second circumferential groove comprising, a third slant surface which continuously links to an outer circumferential end of the second slant surface and whose diameter is gradually reduced with moving to the other end side in the axial direction of the cylinder liner, a second curved surface whose diameter is gradually increased with moving from an inner circumferential end of the third slant surface, and a fourth slant surface whose diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in section view.

3. A cylinder block comprising a cylinder block main body made of aluminum alloy and a cast iron cylinder liner as defined in claim 1 enclosed therein.

4. A process for the preparation of a cast iron cylinder liner having a shape of cylinder hollow to be enclosed in a cylinder block main body made of aluminum alloy by enclosing-casting method, which comprises a plurality of strip-shaped plane surfaces circularly extending in a circumferential direction of the cylinder liner, the circular strip-shaped plane surfaces being formed on an outer circumferential surface of the cylinder liner at intervals in the axis direction, and a plurality of circumferential grooves extending in the circumferential direction, the circumferential grooves being formed between the adjacent strip-shaped plane surfaces, comprising the following steps:

rotating a cylinder liner material casted in the form of circular cylinder around its central axis, and applying a working tool onto an outer circumferential surface of the material to cut a plurality of first circumferential grooves in the axial direction at intervals, each of the first circumferential grooves comprising, a first slant surface which, in its axial sectional view, has circular shape and whose diameter is gradually reduced with moving from an outer circumferential edge of a strip-shaped plane surface existing in one end side in an axial direction of the cylinder liner to an inner circumferential end to undercut a support portion of the strip-shaped plane surface, a first curved surface whose, in its axial sectional view, diameter is gradually reduced with moving from the inner circumferential end of the first slant surface, and a second slant surface whose, in its axial sectional view, diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and rotating the cylinder liner material, on which the plurality of first circumferential grooves have been provided by the cutting, around its central axis, and applying a working tool onto the material to cut a plurality of second circumferential grooves in the axis direction at intervals, each of the second circumferential grooves comprising, a third slant surface which, in its axial sectional view, continuously links to an outer circumferential end of the second slant surface and whose diameter is gradually reduced with moving to the other end side in the axial direction of the cylinder liner, a second curved surface whose, in its axial sectional view, diameter is gradually increased with moving from an inner circumferential end of the third slant surface, and a fourth slant surface whose, in its axial sectional view, diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

5. A process for the preparation of a cast iron cylinder liner having a shape of cylinder hollow to be enclosed in a cylinder block main body made of aluminum alloy by enclosing-casting method, which comprises a strip-shaped plane surface spirally extending in a circumferential direction of the cylinder liner, the spiral strip-shaped plane surface being formed on an outer circumferential surface of the cylinder liner at intervals in the axis direction, and a circumferential groove spirally and continuously formed between the spiral strip-shaped plane surface, comprising the following steps:

rotating a cylinder liner material casted in the form of circular cylinder around its central axis, and applying a working tool onto an outer circumferential surface of the material with moving the tool from one end side in an axis direction of the cylinder liner to the other side end in parallel to the central axis, to cut a first circumferential groove, the first circumferential groove comprising, a spiral first slant surface whose, in its axial sectional view, diameter is gradually reduced with moving from an outer circumferential edge of a strip-shaped plane surface existing in the one end side in an axial direction of the cylinder liner to an inner circumferential end to undercut a support portion of the strip-shaped plane surface, a first curved surface whose, in its axial sectional view, diameter is gradually reduced with moving from the inner circumferential end of the first slant surface, and a second slant surface whose, in its axial sectional view, diameter is gradually increased with moving from an inner circumferential end of the first curved surface to the other end side in the axial direction of the cylinder liner and which faces the first slant surface, the first slant surface, the first curved surface and the second slant surface being continuously linked to each other in this order to form a shape of "J" of the alphabet in sectional view;

and rotating the cylinder liner material, on which the spiral first circumferential groove has been provided by the cutting, around its central axis in a direction opposite to the above-mentioned rotating direction, and applying a working tool onto an outer circumferential surface of the material with moving the tool from the other end side in an axis direction of the cylinder liner to the one side end and in parallel to the central axis, to cut a second circumferential groove, the second circumferential groove comprising, a spiral third slant surface which, in its axial sectional view, continuously links to an outer circumferential end of the second slant surface and whose diameter is gradually reduced with moving to the other end side in the axial direction of the cylinder liner, a second curved surface, in its axial sectional view, whose diameter is gradually increased with moving from an inner circumferential end of the third slant surface, and a fourth slant surface, in its axial sectional view, whose diameter is increased with moving from an outer circumferential end of the second curved surface to the one end side in the axial direction of the cylinder liner, which faces the third slant surface and whose outer circumferential end links to an outer circumferential edge of an adjacent strip-shaped plane surface existing in the other end side in an axial direction of the cylinder liner to undercut a support portion of the strip-shaped plane surface, the third slant surface, the second curved surface and the fourth slant surface being continuously linked to each other in this order to form a shape of "J" of the alphabet in sectional view.

6. A cylinder block comprising a cylinder block main body made of aluminum alloy and a cast iron cylinder liner as defined in claim 2 enclosed therein.

* * * * *